US011700875B1

(12) United States Patent
Docherty et al.

(10) Patent No.: US 11,700,875 B1
(45) Date of Patent: Jul. 18, 2023

(54) COMPOSITIONS AND METHODS FOR SUBLINGUAL DELIVERY OF NICOTINE

(71) Applicant: POVIVA CORP., Carson City, NV (US)

(72) Inventors: John Docherty, Port Perry (CA); Christopher Andrew Bunka, Kelowna (CA)

(73) Assignee: POVIVA CORP., Carson City, NV (US)

( * ) Notice: Subject to any disclaimer, the term of this patent is extended or adjusted under 35 U.S.C. 154(b) by 0 days.

(21) Appl. No.: 17/700,628

(22) Filed: Mar. 22, 2022

(51) Int. Cl.

| | |
|---|---|
| ***A24B 15/16*** | (2020.01) |
| ***A24B 13/00*** | (2006.01) |
| ***A24B 15/32*** | (2006.01) |
| ***A24B 15/42*** | (2006.01) |
| ***A24B 15/40*** | (2006.01) |
| ***A24B 15/30*** | (2006.01) |

(52) U.S. Cl.
CPC ..... *A24B 15/16* (2013.01); *A24B 13/00* (2013.01); *A24B 15/302* (2013.01); *A24B 15/32* (2013.01); *A24B 15/406* (2013.01); *A24B 15/42* (2013.01)

(58) Field of Classification Search
None
See application file for complete search history.

(56) References Cited

U.S. PATENT DOCUMENTS

| | | | | |
|---|---|---|---|---|
| 2010/0170522 | A1* | 7/2010 | Sun | A24B 15/16 131/274 |
| 2021/0204590 | A1* | 7/2021 | Johnson | A24B 15/16 |
| 2021/0345656 | A1* | 11/2021 | Nielsen | A24B 15/16 |
| 2021/0378948 | A1* | 12/2021 | Gerardi | A61K 9/2018 |

* cited by examiner

*Primary Examiner* — Eric Yaary
(74) *Attorney, Agent, or Firm* — FisherBroyles LLP; Anthony Dovale

(57) ABSTRACT

Disclosed herein are compositions and methods for oral delivery of nicotine and nicotine derivatives. In one embodiment the nicotine is delivered in an oral packets, pouches, or sachets.

30 Claims, 4 Drawing Sheets

COMPOSITIONS AND METHODS FOR SUBLINGUAL DELIVERY OF NICOTINE

FIELD

Disclosed herein are compositions and methods for oral delivery of nicotine and nicotine derivatives. In one embodiment the nicotine is delivered in an oral packets, pouches, or sachets.

DETAILED DESCRIPTION OF THE DISCLOSURE

Figure 1:
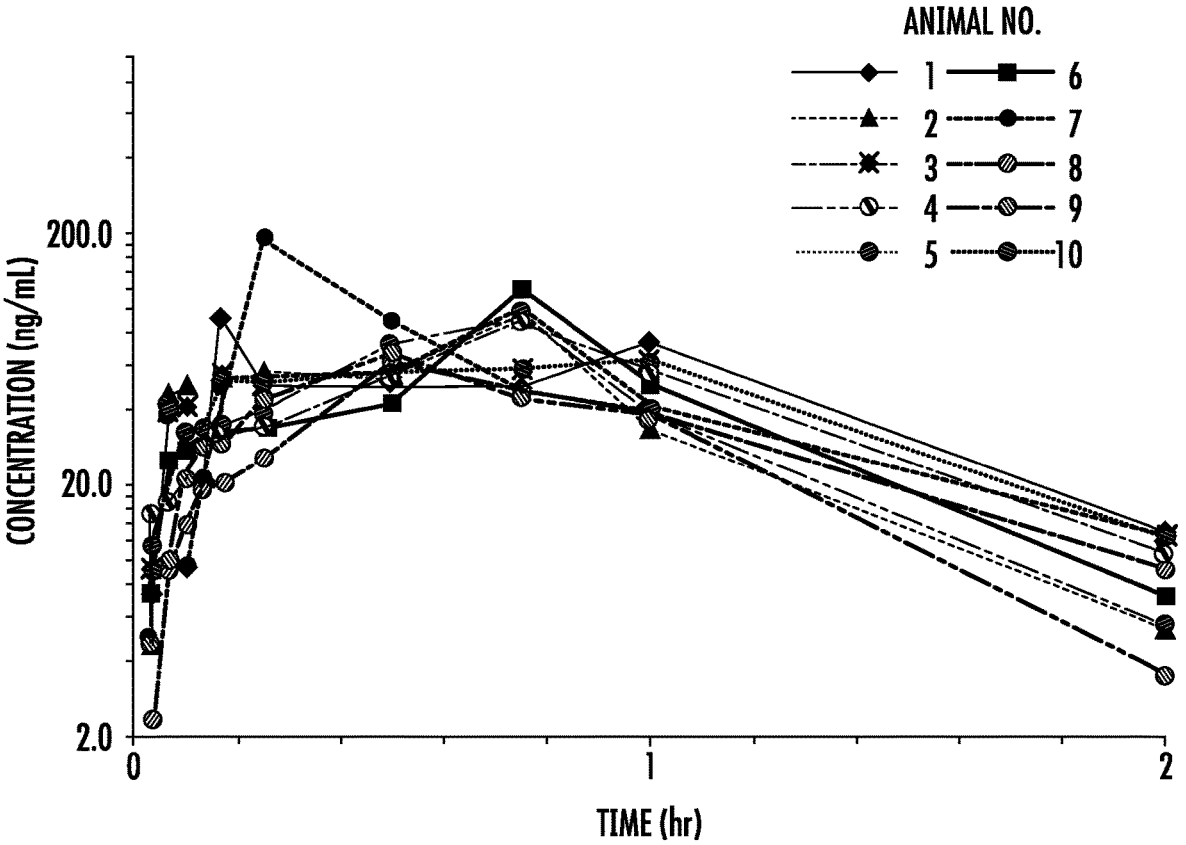
FIG. 1 is a plot of the individual plasma concentrations (ng/mL) for Nicotine versus time (hour) after buccal administration of the nicotine benzoate control composition disclosed in TABLE I in male Beagle dogs.

The materials, compounds, compositions, articles, and methods described herein may be understood more readily by reference to the following detailed description of specific aspects of the disclosed subject matter and the Examples included therein.

Also, throughout this specification, various publications are referenced. The disclosures of these publications in their entireties are hereby incorporated by reference into this application in order to more fully describe the state of the art to which the disclosed matter pertains. The references disclosed are also individually and specifically incorporated by reference herein for the material contained in them that is discussed in the sentence in which the reference is relied upon.

General Definitions

In this specification and in the claims that follow, reference will be made to a number of terms, which shall be defined to have the following meanings:

All percentages, ratios and proportions herein are by weight, unless otherwise specified. All temperatures are in degrees Celsius (° C.) unless otherwise specified.

The terms "a" and "an" are defined as one or more unless this disclosure explicitly requires otherwise.

Ranges may be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, an apparatus that "comprises," "has," "includes" or "contains" one or more elements possesses those one or more elements, but is not limited to possessing only those elements. Likewise, a method that "comprises," "has," "includes" or "contains" one or more steps possesses those one or more steps, but is not limited to possessing only those one or more steps.

Any embodiment of any of the disclosed methods or compositions can consist of or consist essentially of—rather than comprise/include/contain/have—any of the described steps, elements, and/or features. Thus, in any of the claims, the term "consisting of" or "consisting essentially of" can be substituted for any of the open-ended linking verbs recited above, in order to change the scope of a given claim from what it would otherwise be using the open-ended linking verb.

The feature or features of one embodiment may be applied to other embodiments, even though not described or illustrated, unless expressly prohibited by this disclosure or the nature of the embodiments.

Any embodiment of any of the disclosed compounds or methods can consist of or consist essentially of—rather than comprise/include/contain/have—any of the described steps, elements, and/or features. Thus, in any of the claims, the term "consisting of" or "consisting essentially of" can be substituted for any of the open-ended linking verbs recited above, in order to change the scope of a given claim from what it would otherwise be using the open-ended linking verb.

For the purposes of the present disclosure the terms "sublingual" and "buccal" are used interchangeably. The definition of "sublingual" is administration of a drug under the tongue to be absorbed by the tissue therein. The definition of "buccal" is to administer a drug by placing it between your cheek and gum. For the purposes to the present disclosure the user can either place the disclosed compositions under the tongue of between the check and gum, whichever mode of delivery is more convenient. Therefore, the disclose compositions can be absorbed in any manner chosen by the user.

The feature or features of one embodiment may be applied to other embodiments, even though not described or illustrated, unless expressly prohibited by this disclosure or the nature of the embodiments.

A smokeless oral nicotine product can be provided to the user in a portioned or a non-portioned format. Portioned smokeless oral nicotine products can reduce or eliminate the handling of the tobacco by the user, which can offer significant advantages in terms of better hygiene, convenience and/or ease of use.

Disclosed herein are compositions for sublingual delivery of nicotine. Unlike orally delivered compositions, sublingual compositions are absorbed in the mucosa of the mouth and therefore avoid the side effect of direct contact of nicotine with the stomach, intestines and other digestive organs.

Disclosed herein are base compositions for sublingual or buccal delivery of naturally occurring nicotine, comprising:

a) from about 1% to about 6% by weight of nicotine, a nicotine salt, nicotine in combination with a resin, or mixtures thereof;

b) from about 3% to about 20% by weight of sunflower oil;

c) from about 10% to about 20% by weight of sodium bicarbonate; and d) the balance one or more carriers. One aspect of the disclosed compositions, comprises:

a) from about 1% to about 3.5% by weight of nicotine, a nicotine salt, or mixtures thereof;

b) from about 3% to about 10.5% by weight of sunflower oil;

c) from about 10% to about 20% by weight of sodium bicarbonate; and d) the balance one or more carriers. In one non-limiting embodiment of this aspect the base compositions, comprise:

a) from about 1% to about 3.5% by weight of nicotine, a nicotine salt, or mixtures thereof;

b) from about 3% to about 10.5% by weight of sunflower oil;

c) from about 10% to about 20% by weight of sodium bicarbonate; and d) the balance an admixture of microcrystalline cellulose and inulin. Disclosed herein are base compositions for sublingual or buccal delivery of synthetic nicotine, comprising:

a) from about 1% to about 6% by weight of nicotine, a nicotine salt, nicotine in combination with a resin, or mixtures thereof;

b) from about 3% to about 20% by weight of sunflower oil;

c) from about 10% to about 20% by weight of sodium bicarbonate; and d) the balance one or more carriers. One aspect of the disclosed compositions, comprises:

a) from about 1% to about 3.5% by weight of nicotine, a nicotine salt, or mixtures thereof;

b) from about 3% to about 10.5% by weight of sunflower oil;

c) from about 10% to about 20% by weight of sodium bicarbonate; and d) the balance one or more carriers.

In one non-limiting embodiment of this aspect the base compositions, comprise:

a) from about 1% to about 3.5% by weight of nicotine, a nicotine salt, or mixtures thereof;

b) from about 3% to about 10.5% by weight of sunflower oil;

c) from about 10% to about 20% by weight of sodium bicarbonate; and d) the balance an admixture of microcrystalline cellulose and inulin. The disclosed base compositions can comprise from about 1% to about 6% by weight of nicotine, a nicotine salt or nicotine in combination with a resin. In one embodiment, the base composition can comprise from about 1% to about 5% by weight of nicotine, a nicotine salt or nicotine in combination with a resin. In another embodiment, the base composition can comprise from about 2% to about 6% by weight of nicotine, a nicotine salt or nicotine in combination with a resin. In a further embodiment, the base composition can comprise from about 2% to about 5% by weight of nicotine, a nicotine salt or nicotine in combination with a resin. In a yet further embodiment, the base composition can comprise from about 3% to about 5% by weight of nicotine, a nicotine salt or nicotine in combination with a resin. For example, the amount of nicotine, a nicotine salt or nicotine in combination with a resin can be 1%, 2%, 3%, 4%, 5%, or 6% by weight or any fractional amounts, for example, 1.5%, 3,25%, and 5.75%.

The disclosed base compositions can comprise from about 3% to about 20% by weight of sunflower oil. In one embodiment the base compositions can comprise from about 3% to about 15% by weight of sunflower oil. In another embodiment the base compositions can comprise from about 5% to about 17% by weight of sunflower oil. In a further embodiment the base compositions can comprise from about 7.5% to about 15% by weight of sunflower oil. In a still further embodiment the base compositions can comprise from about 5% to about 10% by weight of sunflower oil. For example, the amount of sunflower oil can be 3%, 4%, 5%, 6%, 7%, 8%, 9%, 10%, 11%, 12%, 13%, 14%, 15%, 16%, 17%, 18%, 19%, or 20% by weight of sunflower oil or any fractional amounts, for example, 10.5%, 13.6%, and 17.5%.

According to this aspect the ratio of nicotine, a nicotine salt or nicotine in combination with a resin to sunflower oil is from about 1:1 to about 1:4. For example, the ratio of nicotine, a nicotine salt or nicotine in combination with a resin to sunflower oil can be 1:1, 1:1.1, 1:1.2, 1:1.3, 1:1.4, 1:1.5, 1:1.6, 1:1.7, 1:1.8, 1:1.9, 1:2, 1:2.1, 1:2.2, 1:2.3, 1:2.4, 1:2.5, 1:2.6, 1:2.7, 1:2.8, 1:2.9, or 1:3.

The disclosed base compositions can comprise from about 10% to about 20% by weight of sodium bicarbonate. In one embodiment the base compositions can comprise from about 10% to about 15% by weight of sodium bicarbonate. In another embodiment the base compositions can comprise from about 15% to about 20% by weight of sodium bicarbonate. In a further embodiment the base compositions can comprise from about 12.5% to about 17.5% by weight of sodium bicarbonate. In a still further embodiment the base compositions can comprise from about 14% to about 17% by weight of sodium bicarbonate. For example, the amount of sodium bicarbonate can be 10%, 11%, 12%, 13%, 14%, 15%, 16%, 17%, 18%, 19%, or 20% by weight of sodium bicarbonate or any fractional amounts, for example, 10.5%, 13.6%, and 17.5%.

In another aspect the base compositions can comprise:

a) from about 5 mg to about 50 mg by weight of nicotine, a nicotine salt, nicotine in combination with a resin, or mixtures thereof;

b) from about 15 mg to about 160 mg by weight of sunflower oil; and c) from about 50 mg to about 300 mg by weight of sodium bicarbonate.

The disclosed base compositions can comprise from 5 mg to about 50 mg by weight of nicotine, a nicotine salt, nicotine in combination with a resin, or mixtures thereof. In one embodiment the base compositions can comprise from 10 mg to about 50 mg by weight of nicotine, a nicotine salt, nicotine in combination with a resin, or mixtures thereof In another embodiment the base compositions can comprise from 15 mg to about 40 mg by weight of nicotine, a nicotine salt, nicotine in combination with a resin, or mixtures thereof. In a further embodiment the base compositions can comprise from 10 mg to about 30 mg by weight of nicotine, a nicotine salt, nicotine in combination with a resin, or mixtures thereof. In a still further embodiment the base compositions can comprise from 15 mg to about 30 mg by weight of nicotine, a nicotine salt, nicotine in combination with a resin, or mixtures thereof In a yet further embodiment the base compositions can comprise from 10 mg to about 25 mg by weight of nicotine, a nicotine salt, nicotine in combination with a resin, or mixtures thereof. The base compositions can comprise, for example, 5 mg, 6 mg, 7 mg, 8 mg, 9 mg, 10 mg, 11 mg, 12 mg, 13 mg, 14 mg, 15 mg, 16 mg, 17 mg, 18 mg, 19 mg, 20 mg, 21 mg, 22 mg, 23 mg, 24 mg, 25 mg, 26 mg, 27 mg, 28 mg, 29 mg, 30 mg, 31 mg, 32 mg, 33 mg, 34 mg, 35 mg, 36 mg, 37 mg, 38 mg, 39 mg, 40 mg, 41 mg, 42 mg, 43 mg, 44 mg, 45 mg, 46 mg, 47 mg, 48 mg, 49 mg, or 50 mg by weight of nicotine, a nicotine salt, nicotine in combination with a resin, or mixtures thereof or any fractional amount, for example, 7.5 mg, 22.5 mg, and 34.6 mg.

The disclosed base compositions can comprise from about 15 mg to about 160 mg by weight of sunflower oil. In one embodiment the base compositions can comprise from about 15 mg to about 160 mg by weight of sunflower oil. In another embodiment the base compositions can comprise from about 25 mg to about 120 mg by weight of sunflower oil. In a further embodiment the base compositions can comprise from about 40 mg to about 100 mg by weight of sunflower oil. In a still further embodiment the base compositions can comprise from about 50 mg to about 150 mg by weight of sunflower oil. In a yet further embodiment the base compositions can comprise from about 75 mg to about 120 mg by weight of sunflower oil.

The disclosed base compositions can comprise, for example, 15 mg, 16 mg, 17 mg, 18 mg, 19 mg, 20 mg, 21 mg, 22 mg, 23 mg, 24 mg, 25 mg, 26 mg, 27 mg, 28 mg, 29 mg, 30 mg, 31 mg, 32 mg, 33 mg, 34 mg, 35 mg, 36 mg, 37 mg, 38 mg, 39 mg, 40 mg, 41 mg, 42 mg, 43 mg, 44 mg, 45 mg, 46 mg, 47 mg, 48 mg, 49 mg, 50 mg, 51 mg, 52 mg, 53 mg, 54 mg, 55 mg, 56 mg, 57 mg, 58 mg, 59 mg, 60 mg, 61 mg, 62 mg, 63 mg, 64 mg, 65 mg, 66 mg, 67 mg, 68 mg, 69 mg, 70 mg, 71 mg, 72 mg, 73 mg, 74 mg, 75 mg, 76 mg, 77 mg, 78 mg, 79 mg, 80 mg, 81 mg, 82 mg, 83 mg, 84 mg, 85 mg, 86 mg, 87 mg, 88 mg, 89 mg, 90 mg, 90 mg, 91 mg, 92 mg, 93 mg, 94 mg, 95 mg, 96 mg, 97 mg, 98 mg, 99 mg, 100 mg, 101 mg, 102, mg, 103, mg, 104 mg, 105 mg, 106 mg, 107 mg, 108 mg, 109 mg, 110 mg, 111 mg, 112 mg, 113 mg, 114 mg, 115 mg, 116 mg, 117 mg, 118 mg, 119 mg, 120 mg, 121 mg, 122 mg, 123 mg, 124 mg, 125 mg, 126 mg, 127 mg, 128 mg, 129 mg, 130 mg 31 mg, 132 mg, 133 mg, 134 mg, 135 mg, 136 mg, 137 mg, 138 mg, 139 mg, 140 mg, 141 mg, 142 mg, 143 mg, 144 mg, 145 mg, 146 mg, 147 mg, 148 mg, 149 mg, 150 mg, 151 mg, 152 mg, 153 mg, 154 mg, 155 mg, 156 mg, 157 mg, 158 mg, 159 mg, or 160 mg by weight of sunflower oil or any fractional amount, for example, 27.5 mg, 82.5 mg, and 134.6 mg.

The disclosed base compositions can comprise from about 50 mg to about 300 mg by weight of sodium bicarbonate. In one embodiment the base compositions comprise from about 50 mg to about 100 mg by weight of sodium bicarbonate. In another embodiment the base compositions comprise from about 75 mg to about 100 mg by weight of sodium bicarbonate. In a further embodiment the base compositions comprise from about 100 mg to about 200 mg by weight of sodium bicarbonate. In still further embodiment the base compositions comprise from about 150 mg to about 200 mg by weight of sodium bicarbonate. In a yet further embodiment the base compositions comprise from about 150 mg to about 300 mg by weight of sodium bicarbonate. In a yet another embodiment the base compositions comprise from about 225 mg to about 300 mg by weight of sodium bicarbonate. The disclosed base composition can comprise, for example, 50 mg, 51 mg, 52 mg, 53 mg, 54 mg, 55 mg, 56 mg, 57 mg, 58 mg, 59 mg, 60 mg, 61 mg, 62 mg, 63 mg, 64 mg, 65 mg, 66 mg, 67 mg, 68 mg, 69 mg, 70 mg, 71 mg, 72 mg, 73 mg, 74 mg, 75 mg, 76 mg, 77 mg, 78 mg, 79 mg, 80 mg, 81 mg, 82 mg, 83 mg, 84 mg, 85 mg, 86 mg, 87 mg, 88 mg, 89 mg, 90 mg, 90 mg, 91 mg, 92 mg, 93 mg, 94 mg, 95 mg, 96 mg, 97 mg, 98 mg, 99 mg, 100 mg, 101 mg, 102 mg, 103, mg, 104 mg, 105 mg, 106 mg, 107 mg, 108 mg, 109 mg, 110 mg, 111 mg, 112 mg, 113 mg, 114 mg, 115 mg, 116 mg, 117 mg, 118 mg, 119 mg, 120 mg, 121 mg, 122 mg, 123 mg, 124 mg, 125 mg, 126 mg, 127 mg, 128 mg, 129 mg, 130 mg 31 mg, 132 mg, 133 mg, 134 mg, 135 mg, 136 mg, 137 mg, 138 mg, 139 mg, 140 mg, 141 mg, 142 mg, 143 mg, 144 mg, 145 mg, 146 mg, 147 mg, 148 mg, 149 mg, 150 mg, 151 mg, 152 mg, 153 mg, 154 mg, 155 mg, 156 mg, 157 mg, 158 mg, 159 mg, 160 mg, 161 mg, 162 mg, 163 mg, 164 mg, 165 mg, 166 mg, 167 mg, 168 mg, 169 mg, 170 mg, 171 mg, 172 mg, 173 mg, 174 mg, 175 mg, 167 mg, 177 mg, 178 mg, 179 mg, 180 mg, 181 mg, 182 mg, 183 mg, 184 mg, 185 mg, 186 mg, 187 mg, 188 mg, 189 mg, 190 mg, 191 mg, 192 mg, 193 mg, 194 mg, 195 mg, 196 mg, 197 mg, 198 mg, 199 mg, 200 mg, 201 mg, 202 mg, 203 mg, 204 mg, 205 mg, 206 mg, 207 mg, 208 mg, 209 mg, 210 mg, 211 mg, 212 mg, 213 mg, 214 mg, 215 mg, 216 mg, 217 mg, 218 mg, 219 mg, 220 mg, 221 mg, 222 mg, 223 mg, 224 mg, 225 mg, 226 mg, 227 mg, 228 mg, 229 mg, 230 mg, 231 mg, 232 mg, 233 mg, 234 mg, 235 mg, 236 mg, 237 mg, 238 mg, 239 mg, 240 mg, 241 mg, 242 mg, 243 mg, 244 mg, 245 mg, 246 mg, 247 mg, 248 mg, 249 mg, 250 mg, 251 mg, 252 mg, 253 mg, 254 mg, 255 mg, 256 mg, 257 mg, 258 mg, 259 mg, 260 mg, 261 mg, 262 mg, 263 mg, 264 mg, 265 mg, 266 mg, 267 mg, 268 mg, 269 mg, 270 mg, 271 mg, 272 mg, 273 mg, 274 mg, 275 mg, 276 mg, 277 mg, 278 mg, 279 mg, 280 mg, 281 mg, 282 mg, 283 mg, 284 mg, 285 mg, 286 mg, 287 mg, 288 mg, 289 mg, 290 mg, 290 mg, 291 mg, 292 mg, 293 mg, 294 mg, 295 mg, 296 mg, 297 mg, 298 mg, 299 mg, or 300 mg by weight of sodium bicarbonate, or any fractional amount, for example, 110.5, 220.7 and 250.8.

Nicotine Compounds

Disclosed herein are two sources of nicotine: naturally derived and synthetic. The two forms of nicotine are not combined or otherwise admixed with one another in any of the compositions disclosed herein. The disclosed salts can be formed from either the naturally derived or the synthetic nicotine. The word "nicotine" is used herein to refer to both naturally derived or synthetic nicotine unless otherwise designated as naturally occurring or synthetic nicotine.

The disclosed nicotine compounds are chosen from nicotine, pharmacologically acceptable salts of nicotine, a nicotine complexes, and polymer resins of containing nicotine. Non-limiting examples of nicotine salts includes nicotine benzoate, nicotine lactate, nicotine malate, nicotine ditartrate, nicotine salicylate, nicotine citrate and nicotine levulinate. Non-limiting examples of nicotine in combination with a resin includes nicotine polacrilex and nicotine resinate.

In one non-limiting example the nicotine salt is nicotine benzoate. In another non-limiting example the nicotine salt is nicotine lactate. In a further non-limiting example the nicotine salt is nicotine malate. In a yet further non-limiting example the nicotine salt is nicotine ditartrate. In a still yet further non-limiting example the nicotine salt is nicotine salicylate. In a yet another non-limiting example the nicotine salt is nicotine citrate. In a still yet another non-limiting example the nicotine salt is nicotine levulinate.

Nicotine can be synthesized by the procedure outlined herein below in Scheme I. Synthetic details can be found in Del Castillo E et al., "Enantioselective Synthesis of Nicotine via an Iodine-Mediated Hoffmann-Loffler Reaction," Org. Lett. 2019, 21, 705-708.

Scheme 1

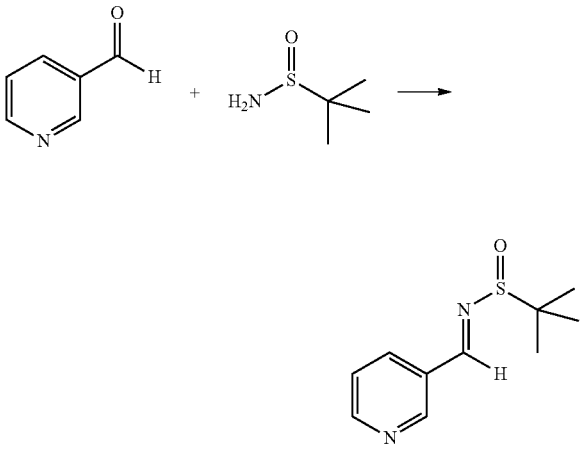

1

Reagents and conditions: a) $Ti(OiPr)_4$; $(CHCl_2)_2$; 80° C.

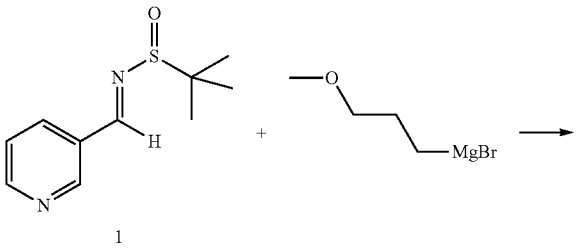

1

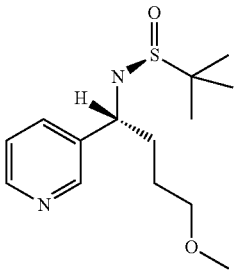

2

Reagents and Conditions: b) THF; −78° C. to rt

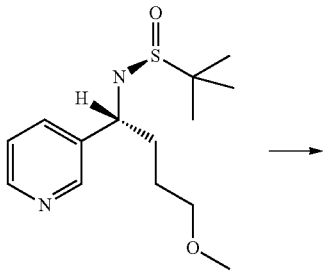

2

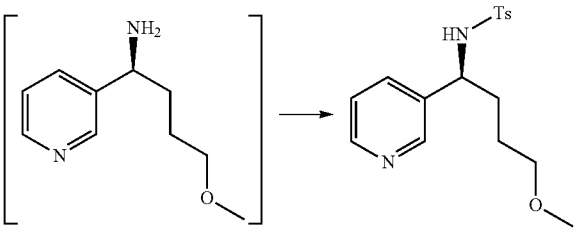

3

Reagents and Conditions: c)(i)HCl/MeOH; then NaOH; (ii) TsCl, $Et_3N$, $CH_2Cl_2$

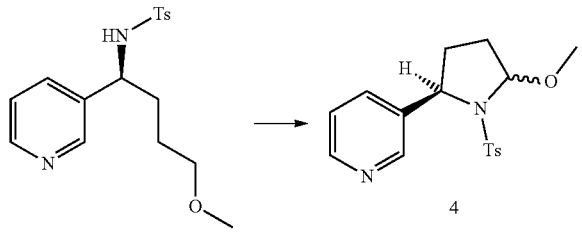

3 4

Reagents and Conditions: d) $I_2$; $PhI(O_2CAr)_2$; $CH_2Cl_2$ rt

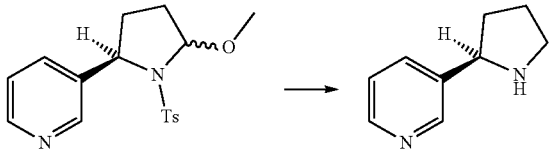

4 5

Reagents and Conditions: (e)(i) $H_2SO_4$, 80° C.; (ii) $NaBH_4$, EtOH, 0° C.

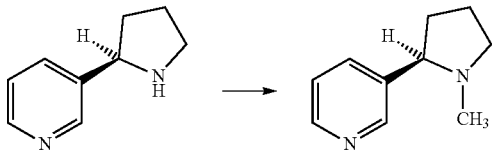

5 (S)-nicotine

Reagents and conditions: (f) $HCO_2H$; $CH_2O$; 80° C.

Carriers

In one aspect the disclosed carriers are polysaccharides. Non-limiting examples of poly saccharide carriers include inulin, galactogen, cellulose, chitin, pectin, psyllium, guar, hemicellulose, potato starch, and partially hydrolyzed polysaccharides. In another aspect the carriers are sugar alcohols, for example, sorbitol, erythritol, xylitol, lactitol, maltitol, mannitol, hydrogenated starch hydrolysates, isomaltose, or any combination thereof In a further aspect carrier component is based on a native or chemically modified agar, alginates, carrageenan gum, cellulose, chitosan, chitin, cyclodextrin, dextran, gellan gum, glycogen, glycosaminoglycan, gum karaya, inulin, pectin, polydextrose, xanthan gum, or any other starches, gums or other polysaccharide, including functionalized derivatives, dextrinized, hydrolyzed, oxidized, alkylated, hydroxyalkylated, acetylated, fractionated, and physically modified starches and mixtures thereof In some embodiments glycerin and/or propylene glycol can be added as a carrier.

In one aspect the carrier can serve as a bulking agent. In one embodiment, microcrystalline cellulose is utilized as a carrier in the base compositions and as a bulking agent in the pouches disclosed herein below. In another embodiment, two or more carriers can be combined, for example, microcrystalline cellulose and inulin. This combination can be utilized in both the base composition, as well as in the pouches. As it relates to the disclosed pouches, dextrin is added as a bulking agent, however, dextrin can also serve as carrier for any flavors that the formulator wishes to add. For example, ethylvanillin is a compound which provides vanilla flavoring. Ethylvanillin can be compounded with dextrin, microcrystalline cellulose or inulin and then admixed with the bulking agents or other carriers.

In one aspect of the one or more carriers, one of the carriers is water soluble while others are not. This allows the formulator to control the release of the active base when the active base is delivered by way of a non-water soluble, but water permeable pouch as described herein below. This combining of carriers allows the delivery of nicotine either via a nicotine salt or by way of a polymer supported nicotine, for example, polacrilex.

The disclosed compositions can comprise from about 80% to about 95% by weight of one or more carriers. In one embodiment the disclosed compositions can comprise from about 80% to about 90% by weight of one or more carriers. In another embodiment the disclosed compositions can comprise from about 85% to about 95% by weight of one or more carriers. In a further embodiment the disclosed compositions can comprise from about 85% to about 90% by weight of one or more carriers.

Antioxidants

The disclosed compositions can comprise about 0.05% or less of an antioxidant. Non-limiting examples of an antioxidant includes butylated hydroxytoluene (BHT), butylated hydroxyanisole (BHA), propyl gallate (PG), tert-butyl hydroquinone (TBHQ), and mixtures thereof.

The following tables disclose non-limiting examples of the base nicotine delivery compositions.

TABLE 1

| Ingredients (mg) | 1 | 2 | 3 | 4 | 5 |
|---|---|---|---|---|---|
| Nicotine benzoate | 5 | 17.5 | 7.5 | 15 | 17.5 |
| Sunflower oil | 15 | 52.5 | 22.5 | 45 | 35 |

TABLE 1-continued

| Ingredients (mg) | 1 | 2 | 3 | 4 | 5 |
|---|---|---|---|---|---|
| Sodium bicarbonate | 50 | 100 | 100 | 100 | 100 |
| Inulin LV 110 | 430 | 330 | 370 | 340 | 347.5 |
| Total | 500 | 500 | 500 | 500 | 500 |

TABLE 2

| Ingredients (mg) | 6 | 7 | 8 | 9 | 10 |
|---|---|---|---|---|---|
| Nicotine benzoate | 12.5 | 17.5 | 5 | 10 | 7.5 |
| Sunflower oil | 25 | 52.5 | 15 | 30 | 22.5 |
| Sodium bicarbonate | 75 | 75 | 100 | 100 | 100 |
| Inulin LV 110 | 387.5 | 355 | 380 | 360 | 340 |
| Total | 500 | 500 | 500 | 500 | 500 |

TABLE 3

| Ingredients (mg) | 11 | 12 | 13 | 14 | 15 |
|---|---|---|---|---|---|
| Nicotine benzoate | 10 | 35 | 15 | 30 | 35 |
| Sunflower oil | 30 | 105 | 45 | 90 | 70 |
| Sodium bicarbonate | 100 | 200 | 200 | 200 | 200 |
| Inulin LV 110 | 860 | 660 | 740 | 680 | 695 |
| Total | 1000 | 1000 | 1000 | 1000 | 1000 |

TABLE 4

| Ingredients (mg) | 16 | 17 | 18 | 19 | 20 |
|---|---|---|---|---|---|
| Nicotine benzoate | 25 | 35 | 10 | 20 | 15 |
| Sunflower oil | 50 | 105 | 30 | 60 | 45 |
| Sodium bicarbonate | 150 | 150 | 200 | 200 | 200 |
| Inulin LV 110 | 775 | 710 | 760 | 720 | 740 |
| Total | 1000 | 1000 | 1000 | 1000 | 1000 |

TABLE 5

| Ingredients (mg) | 21 | 22 | 23 | 24 | 25 |
|---|---|---|---|---|---|
| Nicotine benzoate | 15 | 52.5 | 22.5 | 45 | 52.5 |
| Sunflower oil | 45 | 157.5 | 67.5 | 135 | 105 |
| Sodium bicarbonate | 150 | 300 | 300 | 300 | 300 |
| Inulin LV 110 | 1290 | 990 | 1110 | 1020 | 1042.5 |
| Total | 1500 | 1500 | 1500 | 1500 | 1500 |

TABLE 6

| Ingredients (mg) | 26 | 27 | 28 | 29 | 30 |
|---|---|---|---|---|---|
| Nicotine benzoate | 37.5 | 52.5 | 15 | 30 | 22.5 |
| Sunflower oil | 75 | 157.5 | 45 | 90 | 67.5 |
| Sodium bicarbonate | 225 | 225 | 300 | 300 | 300 |
| Inulin LV 110 | 1162.5 | 1065 | 1140 | 1080 | 1110 |
| Total | 1500 | 1500 | 1500 | 1500 | 1500 |

TABLE 7

| Ingredients (mg) | 31 | 32 | 33 | 34 | 35 |
|---|---|---|---|---|---|
| Nicotine polacrilex | 5 | 17.5 | 7.5 | 15 | 17.5 |
| Sunflower oil | 15 | 52.5 | 22.5 | 45 | 35 |
| Sodium bicarbonate | 50 | 100 | 100 | 100 | 100 |
| Inulin LV 110 | 430 | 330 | 370 | 340 | 347.5 |
| Total | 500 | 500 | 500 | 500 | 500 |

TABLE 8

| Ingredients (mg) | 36 | 37 | 38 | 39 | 40 |
|---|---|---|---|---|---|
| Nicotine polacrilex | 12.5 | 17.5 | 5 | 10 | 7.5 |
| Sunflower oil | 25 | 52.5 | 15 | 30 | 22.5 |
| Sodium bicarbonate | 75 | 75 | 100 | 100 | 100 |
| Inulin LV 110 | 387.5 | 355 | 380 | 360 | 340 |
| Total | 500 | 500 | 500 | 500 | 500 |

TABLE 9

| Ingredients (mg) | 41 | 42 | 43 | 44 | 45 |
|---|---|---|---|---|---|
| Nicotine polacrilex | 10 | 35 | 15 | 30 | 35 |
| Sunflower oil | 30 | 105 | 45 | 90 | 70 |
| Sodium bicarbonate | 100 | 200 | 200 | 200 | 200 |
| Inulin LV 110 | 860 | 660 | 740 | 680 | 695 |
| Total | 1000 | 1000 | 1000 | 1000 | 1000 |

TABLE 10

| Ingredients (mg) | 46 | 47 | 48 | 49 | 50 |
|---|---|---|---|---|---|
| Nicotine polacrilex | 25 | 35 | 10 | 20 | 15 |
| Sunflower oil | 50 | 105 | 30 | 60 | 45 |
| Sodium bicarbonate | 150 | 150 | 200 | 200 | 200 |
| Inulin LV 110 | 775 | 710 | 760 | 720 | 740 |
| Total | 1000 | 1000 | 1000 | 1000 | 1000 |

TABLE 11

| Ingredients (mg) | 51 | 52 | 53 | 54 | 55 |
|---|---|---|---|---|---|
| Nicotine polacrilex | 15 | 52.5 | 22.5 | 45 | 52.5 |
| Sunflower oil | 45 | 157.5 | 67.5 | 135 | 105 |
| Sodium bicarbonate | 150 | 300 | 300 | 300 | 300 |
| Inulin LV 110 | 1290 | 990 | 1110 | 1020 | 1042.5 |
| Total | 1500 | 1500 | 1500 | 1500 | 1500 |

TABLE 12

| Ingredients (mg) | 56 | 57 | 58 | 59 | 50 |
|---|---|---|---|---|---|
| Nicotine polacrilex | 37.5 | 52.5 | 15 | 30 | 22.5 |
| Sunflower oil | 75 | 157.5 | 45 | 90 | 67.5 |
| Sodium bicarbonate | 225 | 225 | 300 | 300 | 300 |
| Inulin LV 110 | 1162.5 | 1065 | 1140 | 1080 | 1110 |
| Total | 1500 | 1500 | 1500 | 1500 | 1500 |

KITS

Disclosed herein are kits for sublingual delivery of nicotine. The kits contain a base nicotine delivery system which comprises the active ingredients and a non-water soluble liquid permeable pouch into which the active ingredients and any necessary adjunct ingredients useful for delivery of the nicotine, nicotine salt of nicotine resin compositions. In one aspect the kit comprises a pouch containing a disclosed composition, comprising:

A) a liquid permeable pouch comprising a non-nicotine composition comprising:

a) one or more delivery agents; and b) a bulking agent; and

B) a base nicotine delivery composition comprising:

a) nicotine, a nicotine salt, nicotine in combination with a resin, or mixtures thereof;

b) sunflower oil;

c) sodium bicarbonate; and d) the balance one or more carriers.

Delivery Control Agents

In order to control sublingual delivery of the disclosed nicotine-containing compositions the kits contain one or more agents that control the release of nicotine into the mouth of the use.

These agents are typically formulated after assembly of the base nicotine delivery compositions; however, the formulator can add a delivery control agent as part of a carrier system.

In one embodiment the delivery agents are solubilizers, for example, lecithins, polyoxyethylene stearate, polyoxyethylene sorbitan fatty acid esters, fatty acid salts, mono and diacetyl tartaric acid esters of mono and diglycerides of edible fatty acids, citric acid esters of mono and diglycerides of edible fatty acids, saccharose esters of fatty acids, polyglycerol esters of fatty acids, polyglycerol esters of interesterified castor oil acid (E476), sodium stearoyl lactylate, sodium lauryl sulfate and sorbitan esters of fatty acids and polyoxyethylated hydrogenated castor oil (for example, CREMOPHOR™), block copolymers of ethylene oxide and propylene oxide (for example, one or more PLURONICS™ or POLOXAMERS™), polyoxyethylene fatty alcohol ethers, polyoxyethylene sorbitan fatty acid esters, sorbitan esters of fatty acids and polyoxyethylene stearic acid esters.

In one embodiment the delivery agent is chosen from sodium stearoyl lactylate, sodium lauryl sulfate, glycerol, propylene glycol, b-cyclodextrin and propylene glycol 400 (PEG 400).

Non-limiting examples of solubilizers includes glycerol, propylene glycol, b-cyclodextrin and propylene glycol 400 (PEG 400).

In one aspect of the disclosed kits, the kits comprise:

A) a liquid permeable pouch comprising a non-nicotine composition comprising:

a) one or more delivery agents; and b) a bulking agent; and

B) a base nicotine delivery composition comprising:

a) nicotine, a nicotine salt, nicotine in combination with a resin, or mixtures thereof;

b) sunflower oil;

c) sodium bicarbonate; and d) the balance one or more carriers.

In one embodiment of this aspect, the kits comprise:

A) a liquid permeable pouch comprising a non-nicotine composition comprising:

a) one or more delivery agents; and b) a bulking agent; and

B) a base nicotine delivery composition comprising:

a) from about 1% to about 6% by weight of nicotine, a nicotine salt, nicotine in combination with a resin, or mixtures thereof;

b) from about 3% to about 20% by weight of sunflower oil;

c) from about 10% to about 20% by weight of sodium bicarbonate; and d) the balance one or more carriers.

In one iteration of this embodiment, the kits comprise:

A) a liquid permeable pouch comprising a non-nicotine composition comprising:

a) maltitol; and b) an admixture of microcrystalline cellulose and inulin; and

B) a base nicotine delivery composition comprising:

a) from about 1% to about 6% by weight of nicotine, a nicotine salt, nicotine in combination with a resin, or mixtures thereof;

b) from about 3% to about 20% by weight of sunflower oil;

c) from about 10% to about 20% by weight of sodium bicarbonate; and d) the balance:

i) dextrose; and ii) a flavorant.

Non-limiting examples of flavorants include apple, banana, cherry, cinnamon, grape, orange, pear, pineapple, raspberry, blueberry, strawberry, spearmint, peppermint, wintergreen, and vanilla.

Disclosed herein is a kit, comprising:

A) a liquid permeable pouch comprising a non-nicotine composition comprising:

a) one or more delivery control agents; and b) a bulking agent; and

B) a base nicotine delivery composition comprising:

a) nicotine, a nicotine salt, nicotine in combination with a resin, or mixtures thereof;

b) sunflower oil;

c) sodium bicarbonate; and d) the balance one or more carriers. In one non-limiting example, the kit comprises:

A) a liquid permeable pouch comprising a non-nicotine composition comprising:

a) one or more delivery control agents; and b) a bulking agent; and

B) from about 70 mg to about 510 mg of an active base delivery system, comprising:

a) from about 5 mg to about 50 mg by weight of nicotine benzoate;

b) from about 15 mg to about 160 mg by weight of sunflower oil;

c) from about 50 mg to about 300 mg by weight of sodium bicarbonate;

d) from about 350 mg to about 1500 mg of one or more carriers; and e) the balance one or more delivery control agents. In another non-limiting example, the kit comprises:

A) a liquid permeable pouch comprising a non-nicotine composition comprising:

a) one or more delivery control agents; and b) a bulking agent; and

B) from about 70 mg to about 510 mg of an active base delivery system, comprising:

a) from about 5 mg to about 50 mg by weight of nicotine polacrilex;

b) from about 15 mg to about 160 mg by weight of sunflower oil;

c) from about 50 mg to about 300 mg by weight of sodium bicarbonate;

d) from about 350 mg to about 1500 mg of one or more carriers; and e) the balance one or more delivery control agents.

PREPARATION

The disclosed base compositions can be prepared by the following general procedure. Naturally occurring nicotine, a nicotine salt, or nicotine in combination with a resin, is combined with sunflower oil in a vessel with adequate stirring. The amount of each ingredient varies depending upon the formulator's choice of the ratio of the nicotine-containing ingredient and sunflower oil, i.e., the ratio of nicotine-containing ingredient to sunflower oil can be, as disclosed herein above, from about 1:1 to about 1:3. The choice of ratio will also dictate the relative amounts of adjunct ingredients that are added. With stirring, the nicotine-containing ingredient sunflower oil admixture is then slowly heated to from about 50° C. to about 75° C., again predicated on the ratio of ingredients and the choice of excipients.

At this point antioxidants, as well as other adjunct ingredients can be optionally added to the nicotine-containing compound/sunflower oil admixture during heating. The amount and ratio of any antioxidants added to the admixture varies depending upon the formulator's choice. In one non-limiting embodiment, the amount of antioxidant is from about 0.01% to about 0.10% by weight of the admixture.

Following the optional addition of an antioxidant and/or other adjunct ingredients, the resulting admixture is then slowly added to a dry particulate substrate with sufficient mixing to form a homogenous dispersion. The quantity of the admixture that is added to the substrate is from about 5% to about 60% by weight. The final dispersion is then dehydrated by which ever means chosen by the formulator, for example, oven drying, lyophilization, convection drying, microwave radiation, etc. In one non-limiting embodiment, the dispersion is dried from about 45 to about 135 minutes. Depending upon many factors including the type of adjunct ingredients and the ratio of the nicotine-containing compound to sunflower oil, the time can be shortened or lengthened.

At this point an alkalizing agent is incorporated. In one non-limiting example, sodium bicarbonate is used as the alkalizing agent. The amount of alkalizing agent is predicated on the amounts of other ingredients and the choice of substrate. In one non-limiting embodiment the composition can comprise from about 1% to about 25% by weight of the alkalizing agent.

After homogenizing the alkalizing agent into the homogeneous admixture now formed, other adjunct ingredients can be added. Non-limiting examples include bulking agents which provide a mouthfeel that is compatible with the pouches, thereby providing the user with a feeling of "substance" inside the pouch. Bulking agents include microcrystalline cellulose and inulin. In addition, sweeteners, for example, maltitol, and/or flavoring compounds are added to provide different oral sensations.

The resulting composition can then be further compounded with other adjunct ingredients, at levels that vary depending upon the formulator's choice, such as bulking agents (e.g., microcrystalline cellulose), high potency sweeteners (e.g., maltitol) and/or flavoring compounds, and ultimately rendered in various different oral or intraoral form factors.

In one non-limiting example, nicotine benzoate (15 g) and sunflower oil (45 g) are combined in a stainless-steel reaction vessel with efficient stirring and heated to 50° C. until homogeneous. The nicotine benzoate sunflower oil admixture is then slowly metered into inulin (500 g) as a dry particulate substrate compound while mixing until homogeneously dispersed. Sodium bicarbonate (20 g) is added while mixing until homogenously dispersed. The admixture is then placed in a convection airflow dehydration chamber for 90 minutes to remove remaining moisture and effect a molecular association between the nicotine and the sunflower oil infused dry particulate. The resulting composition is then combined with microcrystalline cellulose (200 g), maltitol (175 g) and spearmint flavoring (100 g) and then charged to unit dose oral pouches.

Pouches

The properties of the pouch can influence the release of the nicotine, nicotine salt, or nicotine in combination with a resin from the pouch composition and thereby possibly influence the rate of uptake by the user. The disclosed pouches comprise water insoluble fiber which allows moisture, typically the user's saliva, to enter the pouch and solubilize the water-soluble components.

Disclosed herein are water-insoluble pouches which can comprise insoluble fiber, for example, wheat fibers, oat fibers, pea fibers, rice fiber, maize fibers, oat fibers, tomato fibers, barley fibers, rye fibers, sugar beet fibers, buckwheat fibers, potato fibers, cellulose fibers, apple fibers, cocoa fibers, cellulose fiber, powdered cellulose, bamboo fibers, bran fibers or combinations thereof.

In one embodiment the disclosed pouches comprise cellulose prepared by processing alpha-cellulose obtained as a pulp from strains of fibrous plant materials, such as wood pulp. In a further embodiment the pouches can comprise wheat fibers, oat fibers, or combinations thereof. The following are non-limiting examples of plant fibers Vitacel WF 600™, Vitacel HF 600™, Vitacel P95™, Vitacel WF 200™, Vitacel LOO™, Vitacel Erbsenfaser EF 150™, Vitacel bamboo fiberbaf 90™Vitacel HF 600™, Vitacel Cellulose L700G™, Vitacel PF200™, Vitacel potatofiber KF200™, Vitacel bamboo fiberhaf BAF40™, Vitacel Haferfaser/oat fiber HF-401-30™, Vitacel L 00™, Vitacel Cellulose L700G™, Vitacel LC1000™, Vitacel L60020™, Vitacel L600™ or combination thereof.

In formulating pouches containing various amounts of the base nicotine delivery composition it is one embodiment of the present disclosure that the amount of water-insoluble fiber can be reduced without compromising the mouthfeel during use. It is important that the pouch material does not cause swelling in use because this fact can counteract the dissolution of the water-soluble component, thereby preventing the user from experiencing any decrease in pouch content during use.

In addition, the pouch composition can also provide for a desirable mouthfeel such as a soft and/or sticky texture. The desirable texture and mouthfeel can be obtained while still being able to store manufactured pouches together in abutment, for example, in cans and the like without sticking or clumping together to result in ruptures of the pouches when being removed. The desirable mouthfeel can in some embodiments also comprise a tingling sensation reminiscent of tobacco pouches, but without many of the undesirable effects associated therewith, for example, discoloring of tissue.

In one aspect of the disclosed kits, the kits comprise an active base composition and a pouch for delivery of nicotine sublingually to the user.

The disclosed kits can comprise either naturally occurring nicotine or synthetic nicotine, the choice of which is left to the formulator. The kits comprise a water-permeable pouch, into which an active base composition and a delivery system is added. The disclosed pouches comprise:

A) from about 5% to about 20% by weight of an active base composition, comprising"

a) from about 1% to about 6% by weight of nicotine, a nicotine salt, nicotine in combination with a resin, or mixtures thereof b) from about 3% to about 20% by weight of sunflower oil;

c) from about 10% to about 20% by weight of sodium bicarbonate; and

B) from about 80% to about 95% by weight of a delivery system wherein the delivery control system contains one or more delivery control agents, carriers, solubilizers or mixtures thereof.

In one embodiment of this aspect, the pouches comprise:

A) from about 70 mg to about 510 mg of an active base composition, comprising:

a) from about 5 mg to about 50 mg by weight of nicotine benzoate;

b) from about 15 mg to about 160 mg by weight of sunflower oil;

c) from about 50 mg to about 300 mg by weight of sodium bicarbonate;

B) from about 350 mg to about 1500 mg of one or more carriers; and

C) the balance one or more delivery control agents.

In one iteration of this embodiment, the one or more carriers serves as the delivery control agent. For example, a pouch comprising:

a) from about 5 mg to about 50 mg by weight of nicotine benzoate;

b) from about 15 mg to about 160 mg by weight of sunflower oil;

c) from about 50 mg to about 300 mg by weight of sodium bicarbonate; and d) from about 300 mg to about 1300 mg by weight of a carrier chosen from inulin, galactogen, cellulose, chitin, pectin, psyllium, guar, hemicellulose, potato starch, or partially hydrolyzed polysaccharides.

In another iteration of this embodiment, a pouch comprising:

a) from about 5 mg to about 50 mg by weight of nicotine benzoate;

b) from about 15 mg to about 160 mg by weight of sunflower oil;

c) from about 50 mg to about 300 mg by weight of sodium bicarbonate; and d) from about 300 mg to about 1300 mg by weight of a carrier chosen from, sorbitol, erythritol, xylitol, lactitol, maltitol, mannitol, hydrogenated starch hydrolysates, isomaltose, or any combination thereof.

In a still further iteration of this embodiment, a pouch comprising:

a) from about 5 mg to about 50 mg by weight of nicotine benzoate;

b) from about 15 mg to about 160 mg by weight of sunflower oil;

c) from about 50 mg to about 300 mg by weight of sodium bicarbonate; and d) from about 300 mg to about 1300 mg by weight of inulin.

In a yet still further iteration of this embodiment, a pouch comprising:

a) from about 5 mg to about 50 mg by weight of nicotine benzoate;

b) from about 15 mg to about 160 mg by weight of sunflower oil;
c) from about 50 mg to about 300 mg by weight of sodium bicarbonate; and
d) from about 300 mg to about 1300 mg by weight of microcrystalline cellulose.

In a yet still further iteration of this embodiment, a pouch comprising:
a) from about 5 mg to about 50 mg by weight of nicotine benzoat;
b) from about 15 mg to about 160 mg by weight of sunflower oil;
c) from about 50 mg to about 300 mg by weight of sodium bicarbonate; and
d) from about 300 mg to about 1300 mg by weight of an admixture of inulin and microcrystalline cellulose.

In another embodiment of this aspect, the pouches comprise:

A) from about 70 mg to about 510 mg of an active base composition, comprising:
a) from about 5 mg to about 50 mg by weight of nicotine polacrilex;
b) from about 15 mg to about 160 mg by weight of sunflower oil;
c) from about 50 mg to about 300 mg by weight of sodium bicarbonate;

B) from about 350 mg to about 1500 mg of one or more carriers; and

C) the balance one or more delivery control agents.

In one iteration of this embodiment, the one or more carriers serves as the delivery control agent. For example, a pouch comprising:
a) from about 5 mg to about 50 mg by weight of nicotine polacrilex;
b) from about 15 mg to about 160 mg by weight of sunflower oil;
c) from about 50 mg to about 300 mg by weight of sodium bicarbonate; and
d) from about 300 mg to about 1300 mg by weight of a carrier chosen from inulin, galactogen, cellulose, chitin, pectin, psyllium, guar, hemicellulose, potato starch, or partially hydrolyzed polysaccharides.

In another iteration of this embodiment, a pouch comprising:
a) from about 5 mg to about 50 mg by weight of nicotine polacrilex;
b) from about 15 mg to about 160 mg by weight of sunflower oil;
c) from about 50 mg to about 300 mg by weight of sodium bicarbonate; and
d) from about 300 mg to about 1300 mg by weight of a carrier chosen from, sorbitol, erythritol, xylitol, lactitol, maltitol, mannitol, hydrogenated starch hydrolysates, isomaltose, or any combination thereof.

In a still further iteration of this embodiment, a pouch comprising:
a) from about 5 mg to about 50 mg by weight of nicotine polacrilex;
b) from about 15 mg to about 160 mg by weight of sunflower oil;
c) from about 50 mg to about 300 mg by weight of sodium bicarbonate; and
d) from about 300 mg to about 1300 mg by weight of inulin.

In a yet still further iteration of this embodiment, a pouch comprising:
a) from about 5 mg to about 50 mg by weight of nicotine polacrilex;
b) from about 15 mg to about 160 mg by weight of sunflower oil;
c) from about 50 mg to about 300 mg by weight of sodium bicarbonate; and
d) from about 300 mg to about 1300 mg by weight of microcrystalline cellulose.

In a yet still further iteration of this embodiment, a pouch comprising:
a) from about 5 mg to about 50 mg by weight of nicotine polacrilex;
b) from about 15 mg to about 160 mg by weight of sunflower oil;
c) from about 50 mg to about 300 mg by weight of sodium bicarbonate; and
d) from about 300 mg to about 1300 mg by weight of an admixture of inulin and microcrystalline cellulose.

The disclosed compositions can comprise from about 80% to about 95% by weight of one or more delivery control agents, carriers, solubilizers or mixtures thereof. In one embodiment the disclosed compositions can comprise from about 80% to about 90% by weight of one or more delivery control agents, carriers, solubilizers or mixtures thereof. In another embodiment the disclosed compositions can comprise from about 85% to about 95% by weight of one or more delivery control agents, carriers, solubilizers or mixtures thereof. In a further embodiment the disclosed compositions can comprise from about 85% to about 90% by weight of one or more delivery control agents, carriers, solubilizers or mixtures thereof.

PROCESS

The disclosed base compositions can be prepared by the following general procedure. Nicotine, a nicotine salt, or nicotine in combination with a resin, is combined with sunflower oil in a vessel with adequate stirring. The amount of each ingredient varies depending upon the formulator's choice of the ratio of the nicotine-containing ingredient and sunflower oil, i.e., the ratio of nicotine-containing ingredient to sunflower oil is from about 1:1 to about 1:3. The choice of ratio will also dictate the relative amounts of adjunct ingredients that are added. With stirring, the nicotine-containing ingredient sunflower oil admixture is then slowly heated to from about 50° C. to about 75° C., again predicated on the ratio of ingredients and the choice of excipients.

In one non-limiting example, nicotine benzoate (15 g) and sunflower oil (45 g) are combined in a stainless-steel reaction vessel with efficient stirring and heated to 50° C. until homogeneous. Inulin (500 g) is slowly metered in and stirring continued until all the inulin is dispersed. Sodium bicarbonate (150 g) is slowly added while raising the temperature to 60° C. Once the admixture is homogeneous, inulin (790 g) is added at a rate to maintain a homogeneous admixture. The admixture is then slowly cooled to 30° C. and placed in a vacuum oven for 5 hours to remove all of the remaining moisture. The resulting composition can then be combined with additional inulin or microcrystalline cellulose then charged to one or more pouches.

The following are non-limiting examples of compositions delivered by way of an insoluble plant or synthetic pouch.

EXAMPLE 1

| Ingredients (mg) | A | B | C | D | E |
|---|---|---|---|---|---|
| Nicotine benzoate | 5 | 17.5 | 7.5 | 15 | 17.5 |
| Sunflower oil | 15 | 52.5 | 22.5 | 45 | 35 |
| Sodium bicarbonate | 50 | 100 | 100 | 100 | 100 |
| Inulin LV 110 | 300 | 130 | 170 | 240 | 147.5 |
| β-cyclodextrin | 130 | 200 | 200 | 100 | 200 |
| Total | 500 | 500 | 500 | 500 | 500 |

EXAMPLE 2

| Ingredients (mg) | F | G | H | I | J |
|---|---|---|---|---|---|
| Nicotine benzoate | 5 | 17.5 | 7.5 | 15 | 17.5 |
| Sunflower oil | 15 | 52.5 | 22.5 | 45 | 35 |
| Sodium bicarbonate | 50 | 100 | 100 | 100 | 100 |
| Inulin LV 110 | 330 | 180 | 210 | 240 | 247.5 |
| propylene glycol | 100 | 150 | 80 | 100 | 100 |
| Total | 500 | 500 | 500 | 500 | 500 |

EXAMPLE 3

| Ingredients (mg) | K | L | M | N | O |
|---|---|---|---|---|---|
| Nicotine benzoate | 5 | 17.5 | 7.5 | 15 | 17.5 |
| Sunflower oil | 15 | 52.5 | 22.5 | 45 | 35 |
| Sodium bicarbonate | 50 | 100 | 100 | 100 | 100 |
| Inulin LV 110 | 320 | 180 | 270 | 240 | 197.5 |
| glycerol | 110 | 150 | 100 | 100 | 150 |
| Total | 500 | 500 | 500 | 500 | 500 |

EXAMPLE 4

| Ingredients (mg) | P | Q | R | S | T |
|---|---|---|---|---|---|
| Nicotine benzoate | 5 | 17.5 | 7.5 | 15 | 17.5 |
| Sunflower oil | 15 | 52.5 | 22.5 | 45 | 35 |
| Sodium bicarbonate | 50 | 100 | 100 | 100 | 100 |
| Inulin LV 110 | 330 | 230 | 190 | 240 | 247.5 |
| PEG 400 | 100 | 100 | 100 | 100 | 100 |
| Total | 500 | 500 | 500 | 500 | 500 |

EXAMPLE 5

| Ingredients (mg) | U | V | W | X | Y |
|---|---|---|---|---|---|
| Nicotine polacrilex | 5 | 17.5 | 7.5 | 15 | 17.5 |
| Sunflower oil | 15 | 52.5 | 22.5 | 45 | 35 |
| Sodium bicarbonate | 50 | 100 | 100 | 100 | 100 |
| Inulin LV 110 | 300 | 130 | 170 | 240 | 147.5 |
| β-cyclodextrin | 130 | 200 | 200 | 100 | 200 |
| Total | 500 | 500 | 500 | 500 | 500 |

EXAMPLE 6

| Ingredients (mg) | Z | AA | BB | CC | DD |
|---|---|---|---|---|---|
| Nicotine polacrilex | 5 | 17.5 | 7.5 | 15 | 17.5 |
| Sunflower oil | 15 | 52.5 | 22.5 | 45 | 35 |
| Sodium bicarbonate | 50 | 100 | 100 | 100 | 100 |
| Inulin LV 110 | 330 | 180 | 210 | 240 | 247.5 |
| propylene glycol | 100 | 150 | 80 | 100 | 100 |
| Total | 500 | 500 | 500 | 500 | 500 |

EXAMPLE 7

| Ingredients (mg) | EE | FF | GG | HH | II |
|---|---|---|---|---|---|
| Nicotine polacrilex | 5 | 17.5 | 7.5 | 15 | 17.5 |
| Sunflower oil | 15 | 52.5 | 22.5 | 45 | 35 |
| Sodium bicarbonate | 50 | 100 | 100 | 100 | 100 |
| Inulin LV 110 | 320 | 180 | 270 | 240 | 197.5 |
| glycerol | 110 | 150 | 100 | 100 | 150 |
| Total | 500 | 500 | 500 | 500 | 500 |

EXAMPLE 8

| Ingredients (mg) | JJ | KK | LL | MM | NN |
|---|---|---|---|---|---|
| Nicotine polacrilex | 5 | 17.5 | 7.5 | 15 | 17.5 |
| Sunflower oil | 15 | 52.5 | 22.5 | 45 | 35 |
| Sodium bicarbonate | 50 | 100 | 100 | 100 | 100 |
| Inulin LV 110 | 330 | 180 | 190 | 240 | 247.5 |
| PEG 400 | 100 | 100 | 100 | 100 | 100 |
| Total | 500 | 500 | 500 | 500 | 500 |

As demonstrated by the following data and FIGS. 1 to 8, the disclosed compositions are more effective in increasing the plasma level of nicotine via oral delivery than providing nicotine alone in a carrier. The following animal study provides conclusive proof of this fact.

The disclosed animal studies were conducted utilizing the disclosed compositions. Table I summarizes the Study design. Male Beagle dogs from Marshall Bioresources were utilized for this study. Animals were identified by ear tattoo and cage label. The study was not blinded. The animals were healthy at the start of the study. Body weights were recorded at each dosing time point. General health observations were recorded at each dosing and sample collection time point for the duration of the study.

Dosing

Nicotine, 4 mg per pouch, was administered via buccal administration. Animals were anesthetized with propofol at a dose of 6 mg/kg, animals were then intubated and maintained in an anesthetic state using isoflurane at 1-5% and 2 L of oxygen flow. The pouch with test article was placed in the buccal space, rinsed with a small volume of water (0.5-1 mL). Every 5 minutes after placing the pouch the test article test article in the buccal space, the isoflurane mask was removed and the pouch gently squeezed. Special attention was taken to ensure saliva did not leak from the mouth. Following 30 minutes, the pouch test article was removed from the buccal space and the animal allowed to recover from anesthesia. All pouches were retained following dosing. Each pouch was placed in individual conical tube with the animal ID and pouch identification.

TEST COMPOSITIONS

Nicotine Benzoate Control

TABLE I

| Ingredients | % | mg |
|---|---|---|
| Nicotine benzoate | 1.11 | 7 |
| Inulin LV 110 (pre-tested) | 98.89 | 624 |
| Total | 100 | 631 |

Nicotine Benzoate Disclosed Composition

TABLE II

| Ingredients | % | mg |
|---|---|---|
| Nicotine benzoate | 1.37 | 8.6 |
| Sunflower oil | 4.09 | 25.8 |
| Sodium bicarbonate | 13.72 | 86.6 |
| Inulin LV 110 (pre-tested) | 80.82 | 510 |
| Total | 100 | 631 |

Nicotine Polacrilex Control

TABLE III

| Ingredients | % | mg |
|---|---|---|
| Nicotine polacrilex | 3.6 | 20 |
| Glycerin | 0.4 | 2.2 |
| Inulin LV 110 (pre-tested) | 96.0 | 632.8 |
| Total | 100 | 555 |

Nicotine Polacrilex Disclosed Composition

TABLE IV

| Ingredients | % | mg |
|---|---|---|
| Nicotine polacrilex | 3.91 | 21.7 |
| Sunflower oil | 13.04 | 72.6 |
| Sodium bicarbonate | 13.69 | 76.1 |
| Glycerin | 0.44 | 2.4 |
| Inulin LV 110 (pre-tested) | 68.92 | 383.2 |
| Total | 100 | 556 |

As shown in the table below, Group 1 was administered the nicotine benzoate control group. Group 2 was administered the disclosed composition comprising nicotine benzoate. Group 3 was administered the nicotine polacrilex control. Group 4 was administered the disclose composition comprising nicotine polacrilex. The actual amounts based on results of potency testing was 3.12, 3.31, 3.48, and 3.79 mg per pouch, in Groups 1, 2,3, and 4, respectively

TABLE V

| Group # | Test Article | Dosing Route | N= | Dose (mg/ pouch) | Dose Volume | Blood Sampling Time Points |
|---|---|---|---|---|---|---|
| 1 | Nicotine benzoate (Control) | Buccal | 10 | 631 | N/A | |
| 2 | Nicotine benzoate | Buccal | 10 | 631 | N/A | |
| 3 | Nicotine polacrilex (Control) | Buccal | 10 | 555 | N/A | Pre-dose, 2, 4, 6, 8, 10, 15, 30, 45, 60, and 120 minutes post dose* |
| 4 | Nicotine polacrilex | Buccal | 10 | 556 | N/A | |

Sample Collection, Preparation and Storage

Each blood sample (approx. 2000 μL) was collected from the jugular vein in a K2ETDA collection tube and gently inverted several time to mix. The samples were kept on ice until centrifugation at 4° C. for 5 minutes at 3,000×g. Approximately 1000 μL plasma was separated by centrifugation. The resulting plasma samples were stored at -80 C until bioanalysis was conducted.

Quantitative Plasma Sample Analysis

Plasma samples were extracted by protein precipitation and analyzed using LC-MS/MS. Individual and Mean plasma concentrations and resulting pharmacokinetic parameters for nicotine are shown in Tables 4-7. All data are expressed as ng/mL of nicotine. Samples that were below the limit of quantification (1.0 ng/mL in plasma) were excluded from the calculation of mean values. Mean concentrations versus time data are plotted in FIGS. 1-8.

Pharmacokinetic parameters were calculated from the time course of the plasma concentration. Pharmacokinetic parameters were determined with Phoenix WinNonlin (v8.0) software using a noncompartmental model. The maximum plasma concentration (Cmax) and the time to reach maximum plasma concentration (tmax) after dosing were observed from the data. The area under the time concentration curve (AUC) was calculated using the linear trapezoidal rule with calculation to the last quantifiable data point (AUCO-last), and with extrapolation to infinity (AUC∞) if applicable. Plasma half-life (t1/2) was calculated from 0.693/slope of the terminal elimination phase. Mean residence time, MRT, was calculated by dividing the area under the moment curve (AUMC) by the AUC. Any samples below the limit of quantitation (1.0 ng/mL plasma) were not used in the calculation of mean values

DATA

Pharmacokinetic Parameters and Plasma Concentrations (ng/mL) for Nicotine After Buccal Administration of the Nicotine Benzoate Control Composition Disclosed in TABLES VI and VII in Male Beagle Dogs (Group 1)

TABLE VI

| Sample | Animal number | | | | |
|---|---|---|---|---|---|
| time (hr) | 1 | 2 | 3 | 4 | 5 |
| 0.0333 | 15.1 | 7.43 | 4.83 | 5.09 | 2.39 |
| 0.0666 | 18.7 | 24.9 | 46.4 | 9.37 | 9.00 |
| 0.1 | 19.3 | 27.0 | 50.0 | 9.5 | 13.7 |
| 0.122 | 21.5 | 30.7 | 301 | 20.5 | 19.6 |
| 0.167 | 94.1 | 32.1 | 54.3 | 50.3 | 20.0 |

TABLE VI-continued

| Sample time (hr) | Animal number 1 | 2 | 3 | 4 | 5 |
|---|---|---|---|---|---|
| 0.25 | 50.6 | 34.0 | 55.4 | 192.4 | 25.4 |
| 0.5 | 50.9 | 42.6 | 55.9 | 88.9 | 62.8 |
| 0.75 | 49.1 | 121 | 94.2 | 47.4 | 46.9 |
| 1 | 73.3 | 49.8 | 33.9 | 41.1 | 38.6 |
| 2 | 12.8 | 7.05 | 5.4 | 12.1 | 9.17 |
| Dose (mg/kg) | 0.354 | 0.62 | 0.362 | 0.385 | 0.3 |
| $C_{max}$ (ng/mL) | 94.1 | 121 | 94.2 | 192.4 | 62.8 |
| $t_{max}$ (hr) | 0.167 | 0.75 | 0.75 | 0.250 | 0.5 |
| $t_{1/2}$ | 0.547 | ND[2] | ND[2] | 0.614 | 0.516 |
| $MRT_{last}$ (hr) | 0.827 | 0.792 | 0.691 | 0.65 | 0.815 |
| $AUC_{last}$ (hr.ng/mL) | 93.6 | 86.1 | 78.9 | 102.3 | 63.0 |
| $AUC_{\infty}$ (hr.ng/mL) | 104 | ND[2] | ND[2] | 113 | 69.9 |
| $AUC_{last}/D$ (hr.kg.ng/mL/mg) | 264 | 238 | 218 | 266 | 210 |
| $AUC_{\infty}/D$ (hr.kg.ng/mL/mg) | 293 | ND[2] | ND[2] | 294 | 233 |

[1]$AUC_{last}/D$ (hr.kg.ng/mL/mg) and $AUC_{\infty}/D$ (hr.kg.ng/mL/mg) are dose normalized values.
[2]Not determined because the line defining the terminal elimination phase had an $r^2$ of <0.85.

TABLE VII

| Sample time (hr) | Animal number 6 | 7 | 8 | 9 | 10 |
|---|---|---|---|---|---|
| 0.0333 | 15.4 | 4.45 | 11.2 | BLOQ[3] | 9.41 |
| 0.0666 | 17.0 | 10.0 | 181 | 2.32 | 38.5 |
| 0.1 | 21.3 | 21.3 | 33.2 | 6.8 | 40.6 |
| 0.122 | 31.4 | 28.4 | 34.0 | 16.4 | ND[2] |
| 0.167 | 33.4 | 29.0 | 34.9 | 35.3 | 53.7 |
| 0.25 | 34.1 | 43.1 | 38.6 | 49.2 | 50.1 |
| 0.5 | 53.4 | 67.0 | 73.2 | 116.5 | 55.6 |
| 0.75 | 90.5 | 44.1 | 99.4 | 126.7 | 57.8 |
| 1 | 57.2 | 36.2 | 39.5 | 37.8 | 62.8 |
| 2 | 10.5 | 3.46 | 5.53 | 9.6 | 12.4 |
| Dose (mg/kg) | 0.376 | 0.30 | 0.416 | 0.243 | 0.223 |
| $C_{max}$ (ng/mL) | 90.5 | 67.0 | 99.4 | 127 | 62.8 |
| $t_{max}$ (hr) | 0.75 | 0.50 | 0.75 | 0.75 | 1.0 |
| $t_{1/2}$ | ND[2] | 0.326 | ND[2] | ND[2] | ND[2] |
| $MRT_{last}$ (hr) | 0.822 | 0.712 | 0.732 | 0.738 | 0.507 |
| $AUC_{last}$ (hr.ng/mL) | 87.4 | 63.1 | 82.5 | 100 | 89.9 |
| $AUC_{\infty}$(hr.ng/mL) | ND[2] | 64.7 | ND[2] | ND[2] | ND[2] |
| $AUC_{last}/D$ (hr.kg.ng/mL/mg) | 233 | 211 | 198 | 412 | 403 |
| $AUC_{\infty}/D$ (hr.kg.ng/mL/mg) | ND[2] | 216 | ND[2] | ND[2] | ND[2] |

[1]$AUC_{last}/D$ (hr.kg.ng/mL/mg) and $AUC_{\infty}/D$ (hr.kg.ng/mL/mg) are dose normalized values.
[2]Not determined because the line defining the terminal elimination phase had an $r^2$ of <0.85.
[3]BLOQ = below the limit of quantitation (1 ng/mL)

TABLE VIII provides the mean and standard deviation for the results of Animals 1-10.

TABLE VIII

| Sample time (hr) | mean | SD |
|---|---|---|
| 0.0333 | 8.36 | 4.73 |
| 0.0666 | 19.6 | 14.7 |
| 0.1 | 24.3 | 13.7 |
| 0.122 | 25.3 | 6.55 |
| 0.167 | 43.7 | 21.0 |
| 0.25 | 57.3 | 48.4 |
| 0.5 | 66.7 | 24.8 |
| 0.75 | 77.7 | 32.3 |
| 1 | 47.0 | 13.3 |
| 2 | 8.79 | 3.28 |

TABLE VIII-continued

| Sample time (hr) | mean | SD |
|---|---|---|
| Dose (mg/kg) | 0.332 | 0.063 |
| $C_{max}$ (ng/mL) | 101 | 39.0 |
| $t_{max}$ (hr) | 0.617 | 0.258 |
| $t_{1/2}$ | 0.501 | 0.123 |
| $MRT_{last}$ (hr) | 0.759 | 0.062 |
| $AUC_{last}$ (hr.ng/mL) | 84.7 | 13.5 |
| $AUC_{\infty}$(hr.ng/mL) | 87.8 | 24.1 |
| $AUC_{last}/D$ (hr.kg.ng/mL/mg) | 265 | 78.3 |
| $AUC_{\infty}/D$ (hr.kg.ng/mL/mg) | 259 | 40.3 |

Figure 2:
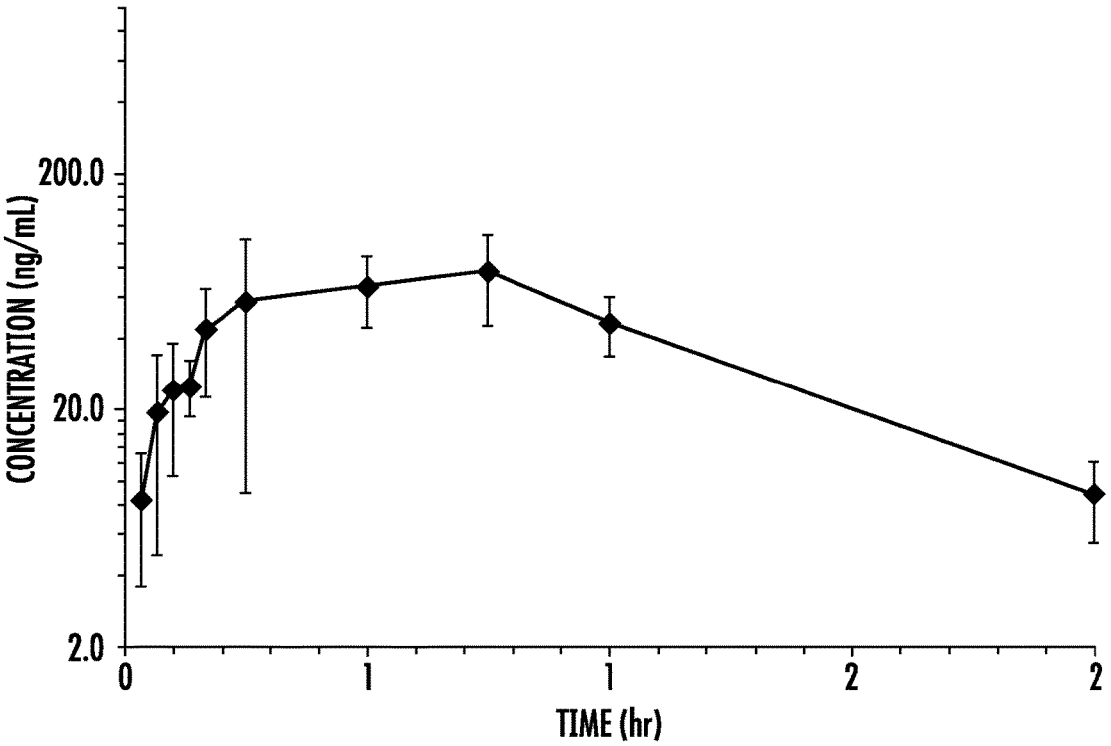
FIG. 2 is a plot of the mean plasma concentration (ng/mL) for Nicotine versus time (hour) after buccal administration of nicotine benzoate control composition disclosed in TABLE I in male Beagle dogs.

FIG. 1 is a plot of the individual plasma concentrations (ng/mL) for Nicotine versus time (hour) after buccal administration of the nicotine benzoate control composition disclosed in TABLE I in male Beagle dogs. FIG. 2 is a plot of the mean plasma concentration (ng/mL) for Nicotine versus time (hour) after buccal administration of nicotine benzoate control composition disclosed in TABLE I in male Beagle dogs.

Pharmacokinetic Parameters and Plasma Concentrations (ng/mL) for Nicotine After Buccal Administration of Pouches Containing the Nicotine Benzoate Disclosed Composition in TABLES IX and X (4 mg) in Male Beagle Dogs (Group 2)

TABLE IX

| Sample time (hr) | Animal number 11 | 12 | 13 | 14 | 15 |
|---|---|---|---|---|---|
| 0.0333 | 132 | 50.0 | 25.6 | 38.8 | 107 |
| 0.0666 | 233 | 70.9 | 64.3 | 332 | 134 |
| 0.1 | 240 | 100 | 78.9 | 446 | 412 |
| 0.122 | 247 | 105 | 88.7 | 349 | 413 |
| 0.167 | 253 | 117 | 98.8 | 258 | 136 |
| 0.25 | 350 | 486 | 113 | 241 | 418 |
| 0.5 | 342 | 175 | 228 | 240 | 647 |
| 0.75 | 150 | 95.7 | 91.8 | 220 | 153 |
| 1 | 88.2 | 6104 | 78.1 | 83.3 | 82.4 |
| 2 | 33.0 | 30.9 | 21.8 | 37.0 | 32.4 |
| Dose (mg/kg) | 0.38 | 0.269 | 0.331 | 0.429 | 0.413 |
| $C_{max}$ (ng/mL) | 350 | 486 | 228 | 446 | 647 |
| $t_{max}$ (hr) | 0.25 | 0.25 | 0.5 | 0.10 | 0.50 |
| $t_{1/2}$ | 0.606 | 0.823 | 0.583 | 0.554 | 0.601 |
| $MRT_{last}$ (hr) | 0.603 | 0.597 | 0.710 | 0.632 | 0.55 |
| $AUC_{last}$ (hr.ng/mL) | 296 | 220 | 173 | 280 | 0397 |
| $AUC_{\infty}$(hr.ng/mL) | 325 | 257 | 191 | 309 | 425 |
| $AUC_{last}/D$ (hr.kg.ng/mL/mg) | 778 | 819 | 523 | 652 | 961 |
| $AUC_{\infty}/D$ (hr.kg.ng/mL/mg) | 854 | 956 | 578 | 720 | 1029 |

[1]$AUC_{last}/D$ (hr.kg.ng/mL/mg) and $AUC_{\infty}/D$ (hr.kg.ng/mL/mg) are dose normalized values.
[2]Not determined because the line defining the terminal elimination phase had an $r^2$ of <0.85.

TABLE X

| Sample time (hr) | Animal number 16 | 17 | 18 | 19 | 20 |
|---|---|---|---|---|---|
| 0.0333 | 34.9 | 14.3 | 556 | 6.85 | 5.63 |
| 0.0666 | 18.2 | 48.4 | 368 | 27.2 | 12.8 |
| 0.1 | 117 | 73.5 | 105 | 384 | 57.9 |
| 0.122 | 125 | 88.1 | 124 | 788 | 73.4 |
| 0.167 | 133 | 89.3 | 130 | 703 | 76.3 |
| 0.25 | 135 | 156 | 131 | 231 | 79.0 |

TABLE X-continued

| Sample | Animal number | | | | |
|---|---|---|---|---|---|
| time (hr) | 16 | 17 | 18 | 19 | 20 |
| 0.5 | 137 | 225 | 150 | 227 | 81.4 |
| 0.75 | 156 | 108 | 70 | 204 | 197 |
| 1 | 46.4 | 107.6 | 53.4 | 81.0 | 52.7 |
| 2 | 17.6 | 23.4 | 11.9 | 21.6 | 16.3 |
| Dose (mg/kg) | 0.380 | 0.318 | 0.341 | 0.290 | 0.301 |
| $C_{max}$ (ng/mL) | 156 | 225 | 150 | 788 | 197 |
| $t_{max}$ (hr) | 0.750 | 0.50 | 0.50 | 0.133 | 0.750 |
| $t_{1/2}$ | ND[2] | 0.530 | 0.481 | 0.418 | ND[2] |
| $MRT_{last}$ (hr) | 0.664 | 0.732 | 0.631 | 0.554 | 0.757 |
| $AUC_{last}$ (hr.ng/mL) | 152 | 201 | 135 | 289 | 133 |
| $AUC_{\infty}$(hr.ng/mL) | ND[2] | 219 | 143 | 302 | ND[2] |
| $AUC_{last}$/D (hr.kg.ng/mL/mg) | 400 | 632 | 395 | 997 | 443 |
| $AUC_{\infty}$/D (hr.kg.ng/mL/mg) | ND[2] | 688 | 420 | 1042 | ND[2] |

[1]$AUC_{last}$/D (hr.kg.ng/mL/mg) and $AUC_{\infty}$/D (hr.kg.ng/mL/mg) are dose normalized values.

[2]Not determined because the line defining the terminal elimination phase had an $r^2$ of <0.85.

[3]BLOQ = below the limit of quantitation (1 ng/mL)

TABLE XI provides the mean and standard deviation for the results of Animals 11-21.

TABLE XI

| Sample time (hr) | mean | SD |
|---|---|---|
| 0.0333 | 46.1 | 44.6 |
| 0.0666 | 108 | 108 |
| 0.1 | 201 | 156 |
| 0.122 | 240 | 226 |
| 0.167 | 207 | 198 |
| 0.25 | 234 | 140 |
| 0.5 | 245 | 158 |
| 0.75 | 145 | 52.1 |
| 1 | 73.4 | 19.3 |
| 2 | 24.6 | 8.83 |
| Dose (mg/kg) | 0.345 | 0.054 |
| $C_{max}$ (ng/mL) | 367 | 220 |
| $t_{max}$ (hr) | 0.423 | 0.232 |
| $t_{1/2}$ | 0.574 | 0.119 |
| $MRT_{last}$ (hr) | 0.643 | 0.072 |
| $AUC_{last}$ (hr.ng/mL) | 228 | 86.2 |
| $AUC_{\infty}$(hr.ng/mL) | 271 | 88.5 |
| $AUC_{last}$/D (hr.kg.ng/mL/mg) | 660 | 223 |
| $AUC_{\infty}$/D (hr.kg.ng/mL/mg) | 786 | 223 |

Figure 3:
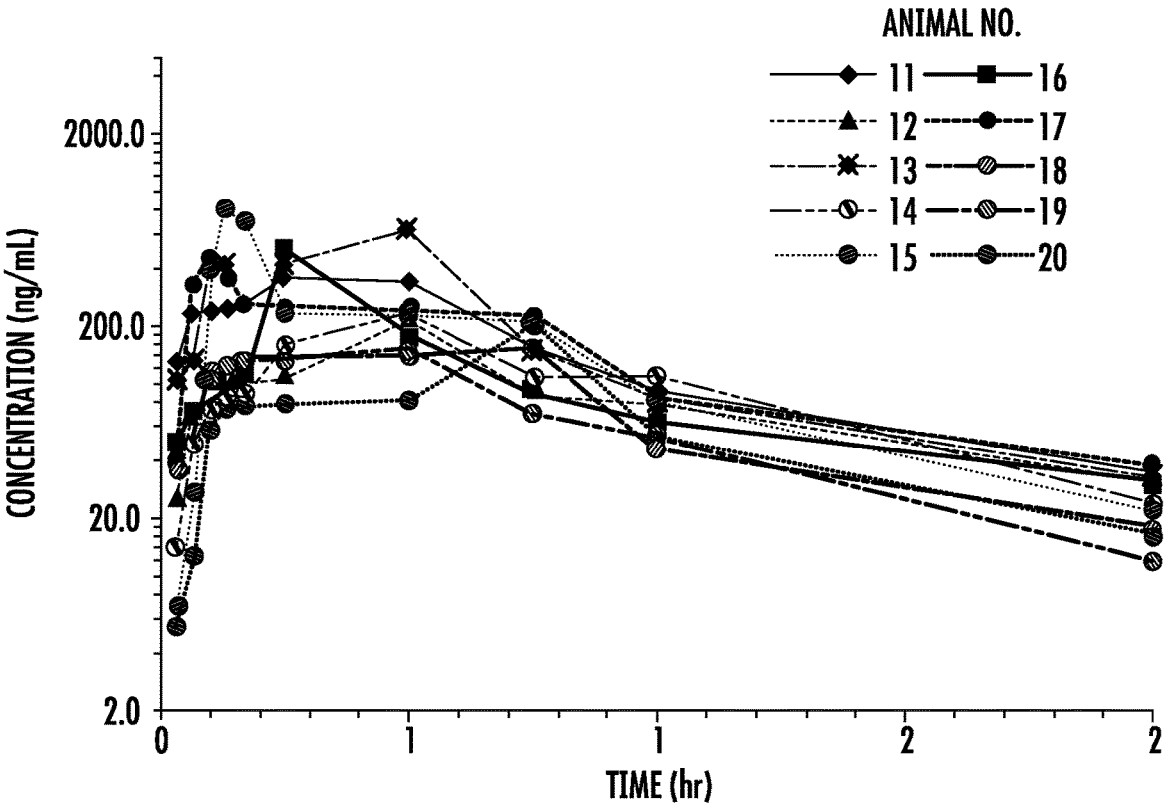
FIG. 3 is a plot of the individual plasma concentrations (ng/mL) for Nicotine versus time (hour) after buccal administration of the disclosed nicotine benzoate composition disclosed in Table II (4 mg) in male Beagle dogs.
Figure 4:
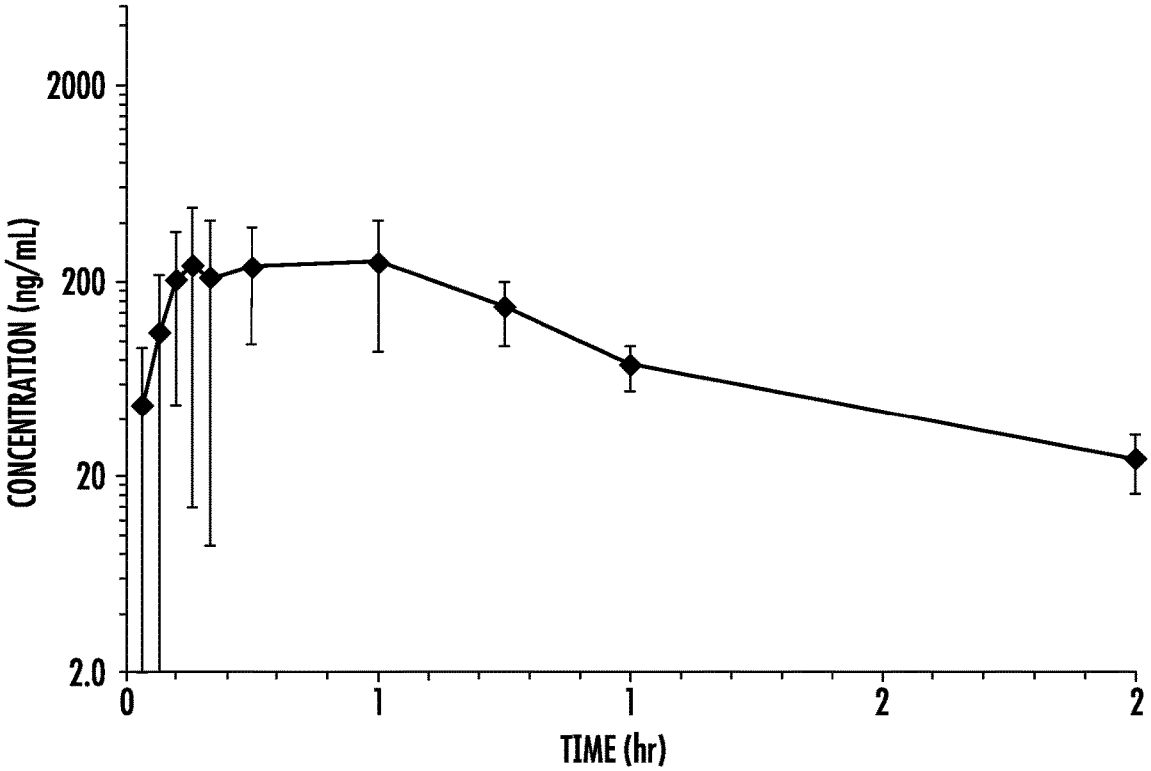
FIG. 4 is a plot of the mean plasma concentration (ng/mL) for Nicotine versus time (hour) after buccal administration of the disclosed compound in Table II (4 mg) in male Beagle dogs.

FIG. 3 depicts the individual plasma concentrations (ng/mL) for Nicotine versus time (hour) after buccal administration of the disclosed nicotine benzoate composition disclosed in Table II (4 mg) in male Beagle dogs. FIG. 4 shows the mean plasma concentration (ng/mL) for Nicotine versus time (hour) after buccal administration of the disclosed compound in Table II (4 mg) in male Beagle dogs.

Pharmacokinetic and Individual Plasma Concentrations (ng/mL) for Nicotine Versus Time (hour) After Buccal Administration of Nicotine Polacrilex Control Composition Disclosed in TABLES XII and XIII (4 mg) in Male Beagle Dogs (Group 3)

TABLE XII

| Sample | Animal number | | | | |
|---|---|---|---|---|---|
| time (hr) | 21 | 22 | 23 | 24 | 25 |
| 0.0333 | 18.3 | 1.36 | BLOQ | BLOQ | 1.146 |
| 0.0666 | 26.3 | 1.73 | 1.55 | 3.08 | 2.76 |
| 0.1 | 27.1 | 2.04 | 1.80 | 4.02 | 5.64 |
| 0.122 | 29.2 | 3.24 | 1.92 | 6.40 | 9.68 |
| 0.167 | 52.7 | 3.54 | 2.44 | 9.00 | 10.1 |
| 0.25 | 29.3 | 4.76 | 7.10 | 9.54 | 11.7 |
| 0.5 | 27.3 | 10.1 | 19.8 | 12.0 | 18.4 |
| 0.75 | 7.34 | 10.9 | 11.6 | 27.6 | 31.3 |
| 1 | 4.60 | 7.18 | 10.4 | 8.36 | 19.7 |
| 2 | 1.32 | 1.61 | 1.7 | 1.34 | 2.59 |
| Dose (mg/kg) | 0.290 | 0.303 | 0.264 | 0.266 | 0.317 |
| $C_{max}$ (ng/mL) | 52.7 | 10.9 | 19.8 | 27.6 | 31.3 |
| $t_{max}$ (hr) | 0.167 | 0.750 | 0.50 | 0.750 | 0.750 |
| $t_{1/2}$ | 0.518 | ND[2] | 0.423 | ND[2] | ND[2] |
| $MRT_{last}$ (hr) | 0.468 | 0.818 | 0.787 | 0.749 | 0.851 |
| $AUC_{last}$ (hr.ng/mL) | 23.5 | 11.8 | 16.7 | 18.4 | 22.2 |
| $AUC_{\infty}$(hr.ng/mL) | 24.5 | ND[2] | 17.7 | ND[2] | ND[2] |
| $AUC_{last}$/D (hr.kg.ng/mL/mg) | 81.0 | 39.0 | 63.3 | 69.2 | 81.4 |
| $AUC_{\infty}$/D (hr.kg.ng/mL/mg) | 84.4 | ND[2] | 67.2 | ND[2] | ND[2] |

[1]$AUC_{last}$/D (hr.kg.ng/mL/mg) and $AUC_{\infty}$/D (hr.kg.ng/Ml/mg) are dose normalized values.

[2]Not determined because the line defining the terminal elimination phase had an $r^2$ of <0.85.

TABLE XIII

| Sample | Animal number | | | | |
|---|---|---|---|---|---|
| time (hr) | 26 | 27 | 28 | 29 | 30 |
| 0.0333 | BLOQ | 1.60 | BLOQ | BLOQ | BLOQ |
| 0.0666 | BLOQ | 2.25 | NS[4] | BLOQ | 3.07 |
| 0.1 | 1.33 | 7.51 | 2.89 | 1.31 | 3.15 |
| 0.122 | 1.74 | 8.62 | 8.35 | 2.71 | 4.02 |
| 0.167 | 5.14 | 6.56 | 31.7 | 9.38 | 4.91 |
| 0.25 | 7.69 | 9.36 | 52.2 | 9.64 | 14.4 |
| 0.5 | 15.4 | 10.4 | 35.5 | 11.9 | 16.0 |
| 0.75 | 16.0 | 10.0 | 34.0 | 30.2 | 45.4 |
| 1 | 18.5 | 9.1 | 15.9 | 20.5 | 21.3 |
| 2 | 1.95 | 1.70 | 2.11 | 2.29 | 1.60 |
| Dose (mg/kg) | 0.272 | 0.363 | 0.400 | 0.290 | 0.484 |
| $C_{max}$ (ng/mL) | 18.5 | 10.4 | 52.2 | 30.2 | 45.4 |
| $t_{max}$ (hr) | 1.00 | 0.50 | 0.250 | 0.750 | 0.750 |
| $t_{1/2}$ | ND[2] | 0.465 | 0.320 | ND[2] | ND[2] |
| $MRT_{last}$ (hr) | 0.851 | 0.778 | 0.645 | 0.849 | 0.802 |
| $AUC_{last}$ (hr.ng/mL) | 22.2 | 14.2 | 39.4 | 26.8 | 32.5 |
| $AUC_{\infty}$(hr.ng/mL) | ND[2] | 15.4 | 40.4 | ND[2] | ND[2] |
| $AUC_{last}$/D (hr.kg.ng/mL/mg) | 81.4 | 39.2 | 98.4 | 92.4 | 67.3 |
| $AUC_{\infty}$/D (hr.kg.ng/mL/mg) | ND[2] | 42.3 | 100.8 | ND[2] | ND[2] |

[1]$AUC_{last}$/D (hr.kg.ng/mL/mg) and $AUC_{\infty}$/D (hr.kg.ng/mL/mg) are dose normalized values.

[2]Not determined because the line defining the terminal elimination phase had an $r^2$ of <0.85.

[3]BLOQ = below the limit of quantitation (1 ng/mL)

TABLE XIV provides the mean and standard deviation for the results of Animals 21-30.

TABLE XIV

| Sample time (hr) | mean | SD |
|---|---|---|
| 0.0333 | 5.58 | 8.48 |
| 0.0666 | 5.82 | 9.05 |
| 0.1 | 5.68 | 7.80 |
| 0.122 | 7.58 | 8.13 |
| 0.167 | 13.5 | 16.1 |
| 0.25 | 15.6 | 14.6 |
| 0.5 | 17.7 | 8.17 |
| 0.75 | 22.4 | 12.9 |
| 1 | 13.6 | 6.27 |
| 2 | 1.82 | 0.412 |
| Dose (mg/kg) | 0.325 | 0.071 |
| $C_{max}$ (ng/mL) | 29.9 | 15.8 |
| $t_{max}$ (hr) | 0.617 | 0.258 |
| $t_{1/2}$ | 0.431 | 0.084 |
| $MRT_{last}$ (hr) | 0.756 | 0.117 |
| $AUC_{last}$ (hr.ng/mL) | 23.5 | 8.66 |
| $AUC_{\infty}$(hr.ng/mL) | 24.5 | 11.3 |
| $AUC_{last}$/D (hr.kg.ng/mL/mg) | 72.3 | 21.0 |
| $AUC_{\infty}$/D (hr.kg.ng/mL/mg) | 73.7 | 25.0 |

Figure 5:
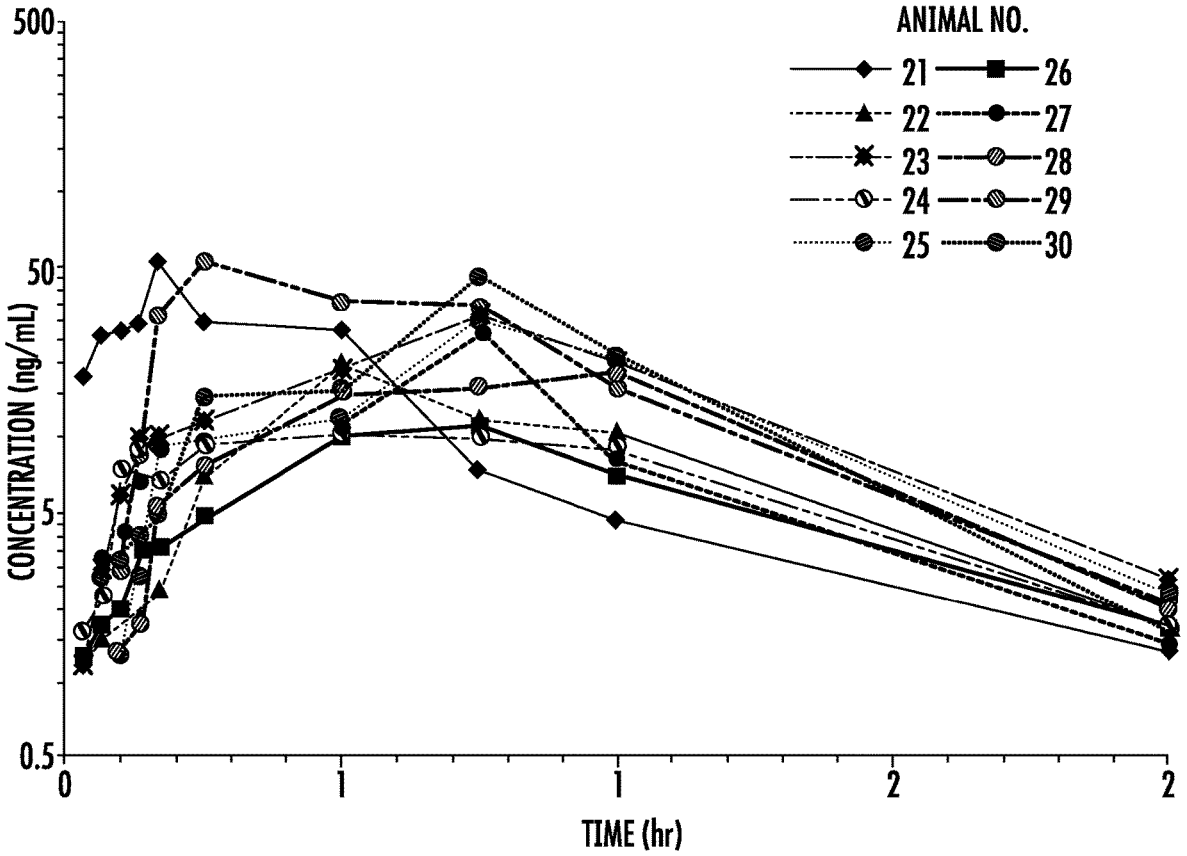
FIG. 5 is a plot of the individual plasma concentrations (ng/mL) for Nicotine versus time (hour) after buccal administration of the nicotine polacrilex control composition disclosed in TABLE III (4 mg) in male Beagle dogs (Group 3).
Figure 6:
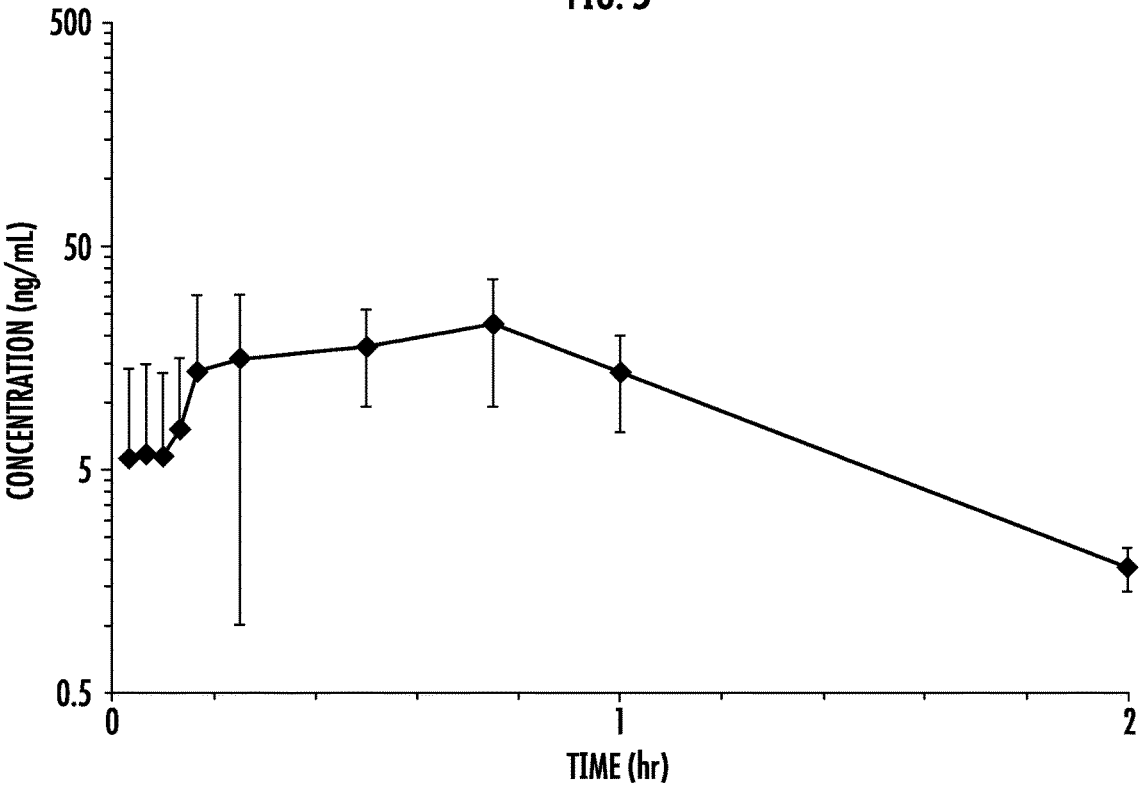
FIG. 6 is a plot of the mean plasma concentration (ng/mL) for Nicotine versus time (hour) after buccal administration of the nicotine polacrilex control composition disclosed in TABLE III (4mg) in Male Beagle dogs (Group 3)

FIG. 5 shows the individual plasma poncentrations (ng/mL) for Nicotine versus time (hour) after buccal administration of the nicotine polacrilex control composition disclosed in TABLE III (4 mg) in male Beagle dogs (Group 3). FIG. 6 displays the mean plasma concentration (ng/mL) for Nicotine versus time (hour) after buccal administration of the nicotine polacrilex control composition disclosed in TABLE III (4 mg) in Male Beagle dogs (Group 3)

Pharmacokinetic Parameters and Plasma Concentrations (ng/mL) for Nicotine After Buccal Administration of Pouches Containing the Nicotine Polacrilex Disclosed composition in TABLES XV and XVI (4 mg) in male Beagle dogs (Group 4)

TABLE XV

| Sample time (hr) | Animal number 31 | 32 | 33 | 34 | 35 |
|---|---|---|---|---|---|
| 0.0333 | 5.50 | 18.9 | 192 | 5.26 | 2.05 |
| 0.0666 | 27.5 | 19.6 | 374 | 44.3 | 10.7 |
| 0.1 | 36.1 | 30.9 | 874 | 51.0 | 44.5 |
| 0.122 | 51.4 | 44.2 | 893 | 63.2 | 50.5 |
| 0.167 | 53.6 | 48.8 | 609 | 66.3 | 74.3 |
| 0.25 | 68.4 | 77.8 | 207 | 86.2 | 100 |
| 0.5 | 120 | 167 | 175 | 118 | 176 |
| 0.75 | 105 | 144 | 149 | 74.4 | 92.0 |
| 1 | 45.1 | 60.8 | 76.2 | 59.2 | 67.2 |
| 2 | 9.77 | 18.2 | 18.7 | 20.6 | 20.6 |
| Dose (mg/kg) | 0.242 | 0.304 | 0.327 | 0.314 | 0.304 |
| $C_{max}$ (ng/mL) | 120 | 167 | 893 | 118 | 176 |
| $t_{max}$ (hr) | 0.500 | 0.500 | 0.133 | 0.500 | 0.500 |
| $t_{1/2}$ | 0.387 | 0.455 | 0.451 | 0.511 | 0.581 |
| $MRT_{last}$ (hr) | 0.709 | 0.749 | 0.485 | 0.731 | 0.744 |
| $AUC_{last}$ (hr.ng/mL) | 108 | 144 | 286 | 116 | 144 |
| $AUC_{\infty}$(hr.ng/mL) | 113 | 156 | 298 | 126 | 161 |
| $AUC_{last}$/D (hr.kg.ng/mL/mg) | 446 | 476 | 874 | 369 | 475 |
| $AUC_{\infty}$/D (hr.kg.ng/mL/mg) | 468 | 515 | 912 | 403 | 531 |

[1]$AUC_{last}$/D (hr.kg.ng/mL/mg) and $AUC_{\infty}$/D (hr.kg.ng/mL/mg) are dose normalized values.
[2]Not determined because the line defining the terminal elimination phase had an $r^2$ of <0.85.

TABLE XVI

| Sample time (hr) | Animal number 36 | 37 | 38 | 39 | 40 |
|---|---|---|---|---|---|
| 0.0333 | 8.03 | 9.83 | 13.2 | 11.1 | 3.67 |
| 0.0666 | 94.4 | 16.8 | 320 | 65.8 | 9.77 |
| 0.1 | 401 | 37.9 | 72.3 | 255 | 21.2 |
| 0.122 | 638 | 53.3 | 81.7 | 238 | 28.6 |
| 0.167 | 817 | 56.1 | 418 | 94.5 | 36.5 |
| 0.25 | 595 | 73.7 | 184 | 331 | 70.4 |
| 0.5 | 225 | 149 | 172 | 217 | 139 |
| 0.75 | 108 | 267 | 160 | 74 | 57.7 |
| 1 | 59.0 | 73.7 | 85.0 | 39.7 | 43.7 |
| 2 | 16.4 | 16.5 | 21.1 | 11.0 | 8.69 |
| Dose (mg/kg) | 0.311 | 0.358 | 0.345 | 0.336 | 0.319 |
| $C_{max}$ (ng/mL) | 817 | 267 | 418 | 331 | 139 |
| $t_{max}$ (hr) | 0.167 | 0.750 | 0.167 | 0.250 | 0.500 |
| $t_{1/2}$ | 0.481 | ND[2] | 0.473 | 0.475 | 0.449 |
| $MRT_{last}$ (hr) | 0.443 | 0.795 | 0.662 | 0.495 | 0.700 |
| $AUC_{last}$ (hr.ng/mL) | 313 | 183 | 209 | 193 | 97 |
| $AUC_{\infty}$(hr.ng/mL) | 325 | ND[2] | 223 | 200 | 102 |
| $AUC_{last}$/D (hr.kg.ng/mL/mg) | 1008 | 511 | 605 | 574 | 303 |
| $AUC_{\infty}$/D (hr.kg.ng/mL/mg) | 1044 | ND[2] | 647 | 596 | 321 |

[1]$AUC_{last}$/D (hr.kg.ng/mL/mg) and $AUC_{\infty}$/D (hr.kg.ng/mL/mg) are dose normalized values.
[2]Not determined because the line defining the terminal elimination phase had an $r^2$ of <0.85.
[3]BLOQ = below the limit of quantitation (1 ng/mL)

TABLE XVII provides the mean and standard deviation for the results of Animals 31-40.

TABLE XVII

| Sample time (hr) | mean | SD |
|---|---|---|
| 0.0333 | 27.0 | 58.3 |
| 0.0666 | 73.6 | 116 |
| 0.1 | 182 | 273 |
| 0.122 | 214 | 302 |
| 0.167 | 242 | 297 |
| 0.25 | 179 | 169 |
| 0.5 | 166 | 36.2 |
| 0.75 | 123 | 61.3 |
| 1 | 60.9 | 15.0 |
| 2 | 16.5 | 5.66 |
| Dose (mg/kg) | 0.316 | 0.032 |
| $C_{max}$ (ng/mL) | 345 | 287 |
| $t_{max}$ (hr) | 0.397 | 0.204 |
| $t_{1/2}$ | 0.474 | 0.052 |
| $MRT_{last}$ (hr) | 0.651 | 0.127 |
| $AUC_{last}$ (hr.ng/mL) | 1799 | 73.7 |
| $AUC_{\infty}$(hr.ng/mL) | 190 | 79.6 |
| $AUC_{last}$/D (hr.kg.ng/mL/mg) | 564 | 219 |
| $AUC_{\infty}$/D (hr.kg.ng/mL/mg) | 604 | 235 |

Figure 7:
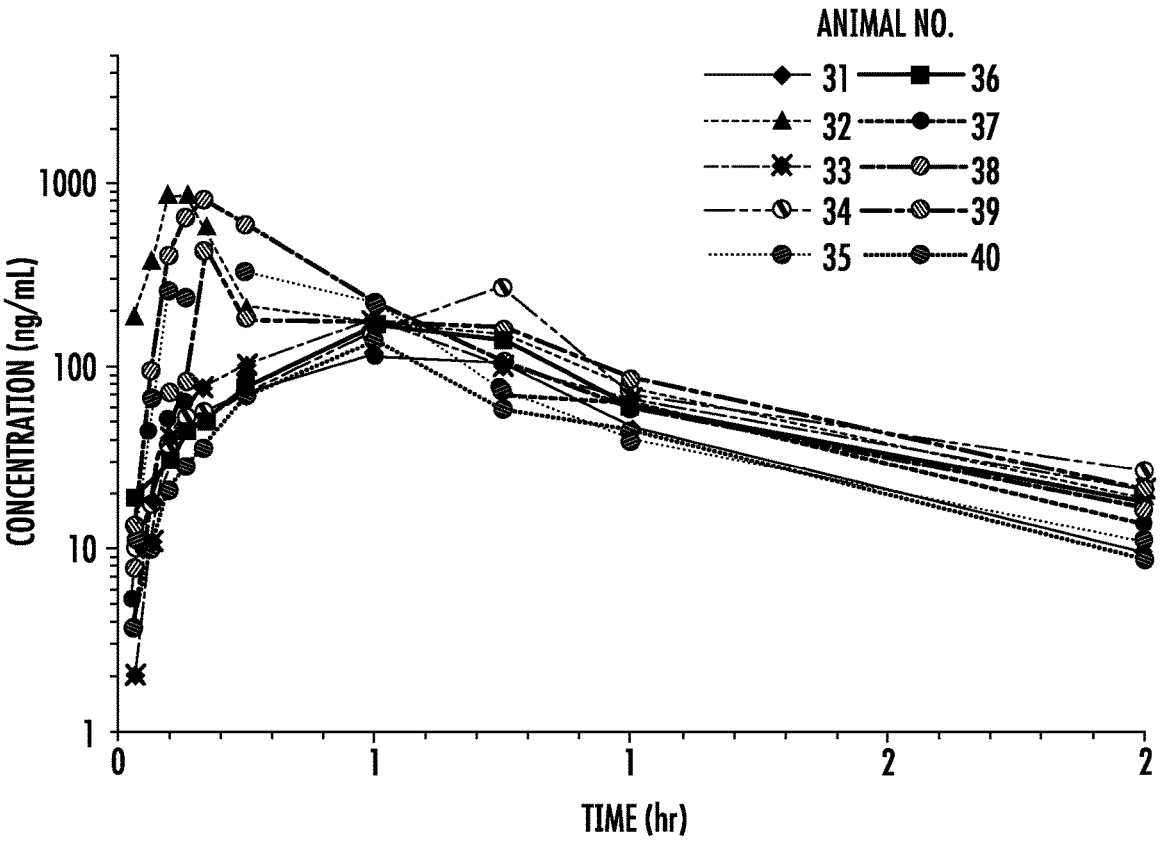
FIG. 7 is a plot of the individual plasma poncentrations (ng/mL) for Nicotine versus time (hour) after buccal administration of the nicotine polarcilex composition disclosed in TABLE VI (4mg) in male Beagle dogs (Group 4).
Figure 8:
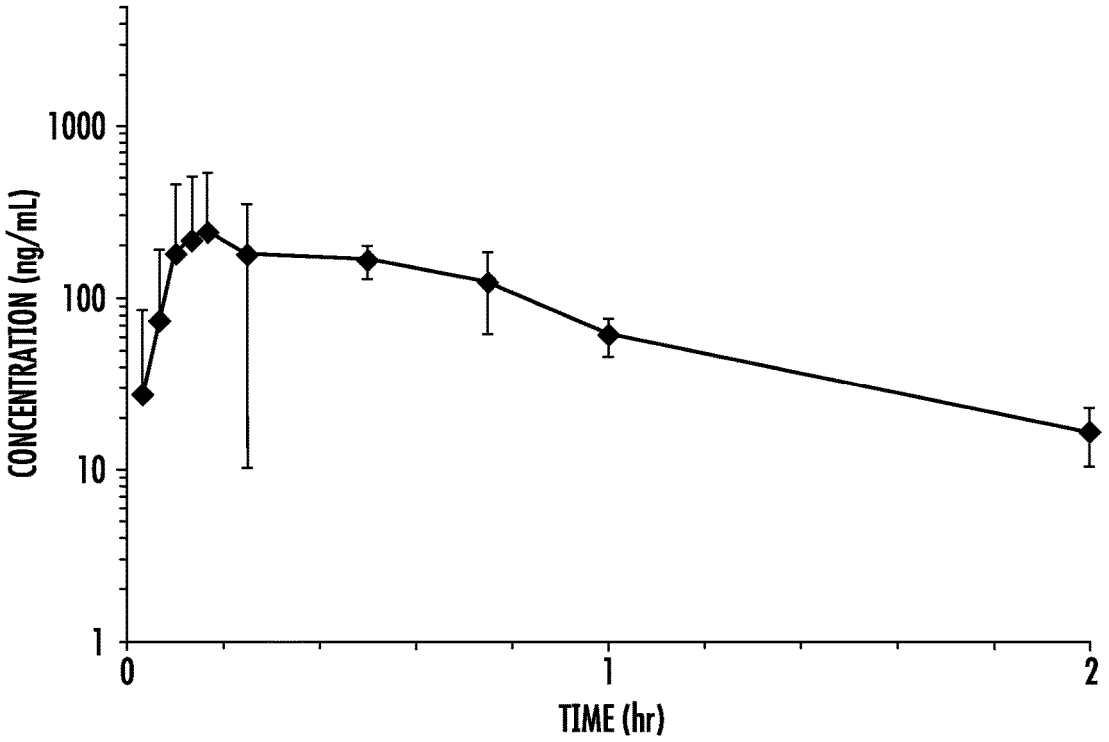
FIG. 8 is a plot of the mean plasma concentration (ng/mL) for Nicotine versus time (hour) after buccal administration of the nicotine polarcrilex composition disclosed in TABLE VI (4 mg) in male Beagle dogs (Group 4).

FIG. 7 shows the individual plasma poncentrations (ng/mL) for Nicotine versus time (hour) after buccal administration of the nicotine polarcilex composition disclosed in TABLE VI (4 mg) in male Beagle dogs (Group 4). FIG. 8 discloses the mean plasma concentration (ng/mL) for Nicotine versus time (hour) after buccal administration of the nicotine polarcrilex composition disclosed in TABLE VI (4 mg) in male Beagle dogs (Group 4).

PROCEDURES

Analytical Stock Solution Preparation

Analytical stock solutions (1.00 mg/mL of the free drug) was prepared in water.

Standard Preparation

Standards were prepared in blank male Beagle dog plasma. Working solutions were prepared in 50:50 acetonitrile:water. Working solutions were then added to plasma to make calibration standards to final concentrations of 2000, 1000, 500, 250, 100, 50, 10, 5, 2 and 1 ng/mL. Standards were treated identically to the study samples.

Sample Extraction

Plasma samples were manually extracted via precipitation with acetonitrile in a 96-well plate.

| Step | Procedure |
|---|---|
| 1 | Standards: Add 10 μL of appropriate working solution to 50 μL of blank plasma.<br>Blanks: Add 10 μL of 50:50 (v:v) acetonitrile:water to 50 μL of blank plasma.<br>Samples: Add 10 μL of 50:50 (v:v) acetonitrile:water to 50 μL of plasma study sample. |
| 2 | Add 150 μL of acetonitrile containing 20 ng/mL nicotine-$d_4$ in acetonitrile as an internal standard. Cap and vortex. |
| 3 | Centrifuge samples at 4° C., at 3000 rpm for 5 minutes. |
| 4 | Transfer 125 μL supernatant and analysis by LC-MS/MS |

HPLC Conditions

Instrument: Waters Acquity UPLC

Column: Waters Phenyl BEH 1.7 μm, 2.1×50 mm

Aqueous Reservoir (A): 10 mm Ammonium bicarbonate in water, pH 9.5

Organic Reservoir (B): Acetonitrile

Gradient Program

| Time (min.) | Gradient Curve | % A | % B |
|---|---|---|---|
| 0.00 | 6 | 90 | 10 |
| 0.20 | 6 | 90 | 10 |
| 1.00 | 6 | 10 | 90 |
| 1.50 | 6 | 10 | 95 |
| 1.51 | 6 | 90 | 10 |
| 2.00 | 6 | 90 | 10 |

Flow Rate: 600 μL/min

Injection Volume: 3 μL

Run Time: 2.0 min

Column Temperature: 30° C.

Sample Temperature: 4° C.

Strong Autosampler Wash: 1:1:1:1 (v:v) acetonitrile: methanol:isopropanol:water

Weak Autosampler Wash: 50:50 (v:v) methanol:water

Mass Spectrometer Conditions

Instrument: Waters Xevo TQ-MS

Interface: Electrospray

Mode: Multiple Reaction Monitoring (MRM)

Desolvation Gas: 1000 L/hr

Cone Gas: 100 L/hr

Collision Gas: 0.25 mL/min

Desolvation Temp: 500° C.

Capillary Voltage: 2.5 kV

While particular embodiments of the present disclosure have been illustrated and described, it would be obvious to those skilled in the art that various other changes and modifications can be made without departing from the spirit and scope of the disclosure. It is therefore intended to cover in the appended claims all such changes and modifications that are within the scope of this disclosure.

What is claimed is:

1. A composition, consisting of:

a) from about 1% to about 6% by weight of a source of nicotine chosen from nicotine benzoate, nicotine polarcrilex, or mixtures thereof;

b) from about 3% to about 18% by weight of sunflower oil;

c) from about 10% to about 20% by weight of sodium bicarbonate; and d) from about 80% to about 95% by weight of inulin, microcrystalline cellulose, or mixtures thereof;

and wherein further the ratio of nicotine benzoate or nicotine polarcrilex to sunflower oil is from about 1:1 to about 1:3.

2. The composition according to claim 1, wherein the range of the source of nicotine is from about 2% to about 6% by weight.

3. The composition according to claim 1, wherein the range of the source of nicotine is from about 2% to about 5% by weight.

4. The composition according to claim 1, wherein the range of the source of nicotine is from about 3% to about 5% by weight.

5. The composition according to claim 1, wherein the source of nicotine is nicotine benzoate.

6. The composition according to claim 1, wherein the source of nicotine is nicotine polacrilex.

7. The composition according to claim 1, wherein the range of sunflower oil is from about 3% to about 15% by weight.

8. The composition according to claim 1, wherein the range of sunflower oil is from about 5% to about 17% by weight.

9. The composition according to claim 1, wherein the range of sunflower oil is from about 5% to about 10% by weight.

10. The composition according to claim 1, wherein the range of sodium bicarbonate is from about 10% to about 15% by weight.

11. The composition according to claim 1, wherein the range of sodium bicarbonate is from about 12.5% to about 17.5% by weight.

12. The composition according to claim 1, wherein the carrier is inulin.

13. The composition according to claim 1, wherein the carrier is microcrystalline cellulose.

14. The composition according to claim 1, wherein the carrier is a combination of inulin and microcrystalline cellulose.

15. A composition, consisting of:

a) from about 5 mg to about 50 mg by weight of a source of nicotine chosen from nicotine benzoate, nicotine polarcrilex, or mixtures thereof;

b) from about 15 mg to about 150 mg by weight of sunflower oil;

c) from about 50 mg to about 300 mg by weight of sodium bicarbonate; and d) from about 230 mg to about 430 mg by weight of inulin, microcrystalline cellulose, or mixtures thereof;

acid and wherein further the ratio of nicotine benzoate or nicotine polarcrilex to sunflower oil is from about 1:1 to about 1:3.

16. The composition according to claim 15, wherein the range of the source of nicotine is from about 15 to about 40 mg.

17. The composition according to claim 15, wherein the range of the source of nicotine is from about 15 to about 30 mg.

18. The composition according to claim 15, wherein the source of nicotine is nicotine benzoate.

19. The composition according to claim 15, wherein the source of nicotine is polarcrilex.

20. The composition according to claim 15, wherein the range of sunflower oil is from about 25 mg to about 120 mg.

21. The composition according to claim 15, wherein the range of sunflower oil is from about 25 mg to about 120 mg.

22. The composition according to claim 15, wherein the carrier is inulin.

23. The composition according to claim 15, wherein the carrier is microcrystalline cellulose.

24. A kit, consisting of :

a liquid permeable pouch wherein the pouch comprises an insoluble fiber chosen from wheat fibers, oat fibers, pea fibers, rice fiber, maize fibers, oat fibers, tomato fibers, barley fibers, rye fibers, sugar beet fibers, buckwheat fibers, potato fibers, cellulose fibers, apple fibers, cocoa fibers, cellulose fiber, powdered cellulose, bamboo fibers, bran fibers or combinations thereof, the pouch containing:

a) from about 1% to about 6% by weight of a source of nicotine chosen from nicotine benzoate, nicotine polarcrilex, or mixtures thereof;

b) from about 3% to about 18% by weight of sunflower oil;

c) from about 10% to about 20% by weight of sodium bicarbonate; and d) from about 80% to about 95% by weight of inulin, microcrystalline cellulose, or mixtures thereof;

and wherein further the ratio of nicotine benzoate or nicotine polarcrilex to sunflower oil is from about 1:1 to about 1:3.

25. The kit according to claim 24, wherein the range of the source of nicotine is from about 2% to about 6% by weight, the range of sunflower oil is from about 3% to about 15% by weight, and the range of sodium bicarbonate is from about 10% to about 15% by weight.

26. The kit according to claim 24, wherein the source of nicotine is nicotine benzoate.

27. The kit according to claim 24, wherein the source of nicotine is nicotine polacrilex.

28. The kit according to claim 24, wherein the carrier is inulin, microcrystalline cellulose or mixtures thereof.

29. The kit according to claim 24, wherein the carrier is microcrystalline cellulose.

30. The kit according to claim 24, wherein the carrier is inulin.

* * * * *